US009355522B2

(12) United States Patent
Wood et al.

(10) Patent No.: US 9,355,522 B2
(45) Date of Patent: May 31, 2016

(54) WAGERING GAME INTERFACE INCLUDING A PLURALITY OF BASE GAMES AND A COMMON VIRTUAL TOP BOX

(71) Applicant: WMS Gaming Inc., Waukegan, IL (US)

(72) Inventors: Thomas Robert Wood, Alnö (SE); Andrew C. Guinn, Chicago, IL (US); Damon E. Gura, Chicago, IL (US); Richard B. Robbins, Glenview, IL (US); Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 34 days.

(21) Appl. No.: 13/789,344

(22) Filed: Mar. 7, 2013

(65) Prior Publication Data

US 2014/0256409 A1 Sep. 11, 2014

(51) Int. Cl.
*G07F 17/32* (2006.01)

(52) U.S. Cl.
CPC ..... *G07F 17/326* (2013.01)

(58) Field of Classification Search
USPC ..... 463/19, 20, 25, 30
See application file for complete search history.

(56) References Cited

U.S. PATENT DOCUMENTS

| | | | | |
|---|---|---|---|---|
| 6,517,433 | B2 | 2/2003 | Loose et al. | 463/20 |
| 7,662,040 | B2 | 2/2010 | Englman et al. | 463/42 |
| 7,780,531 | B2 | 8/2010 | Englman et al. | 463/42 |
| 7,833,094 | B2 | 11/2010 | Englman et al. | 463/25 |
| 8,057,294 | B2 | 11/2011 | Pacey et al. | 463/20 |
| 8,057,295 | B2 | 11/2011 | Vann et al. | 463/20 |
| 8,123,610 | B2 | 2/2012 | Hornik | 463/20 |
| 8,172,687 | B2 | 5/2012 | Gagner et al. | 463/42 |
| 8,197,331 | B2 | 6/2012 | Pacey et al. | 463/20 |
| 8,221,228 | B2 | 7/2012 | Anderson et al. | 463/25 |
| 8,235,785 | B2 | 8/2012 | Thomas | 463/16 |
| 8,262,456 | B2 | 9/2012 | Englman et al. | 463/20 |
| 8,267,774 | B2 | 9/2012 | Englman et al. | 463/23 |
| 8,292,731 | B2 | 10/2012 | Collette et al. | 463/26 |
| 8,303,394 | B2 | 11/2012 | Englman et al. | 463/16 |
| 8,317,603 | B2 | 11/2012 | Anderson | 463/25 |
| 8,342,927 | B2 | 1/2013 | Englman et al. | 463/6 |
| 8,371,919 | B2 | 2/2013 | Hornik et al. | 463/16 |
| 8,403,758 | B2 | 3/2013 | Hornik et al. | 463/42 |
| 8,435,120 | B2 | 5/2013 | Hornik et al. | 463/42 |
| 2006/0009283 | A1 | 1/2006 | Englman et al. | 463/29 |
| 2006/0073880 | A1 | 4/2006 | Thomas | 463/20 |
| 2006/0073897 | A1 | 4/2006 | Englman et al. | 463/42 |
| 2006/0135243 | A1 | 6/2006 | Englman et al. | 463/16 |

(Continued)

*Primary Examiner* — Paul A D'Agostino
*Assistant Examiner* — Brandon Gray
(74) *Attorney, Agent, or Firm* — Nixon Peabody LLP

(57) ABSTRACT

A gaming system and method includes a primary wagering game displayed in a display area that is subdivided into display regions. The primary game includes a plurality of base games. The base games are displayed in a respective one of the display regions and each has a virtual character associated therewith. A simulated top box is displayed in one of the display regions. The simulated top box includes a secondary game common to the plurality of base games. In response to play of the primary wagering game being initiated, an outcome is determined for each of the plurality of base games and the outcomes are concurrently displayed. In response to a bonus trigger, at least two of the plurality of base games combine into a single bonus array of symbols for a bonus game. The single bonus array of symbols is displayed in one or more of the display regions.

35 Claims, 14 Drawing Sheets

(56) References Cited

U.S. PATENT DOCUMENTS

| | | | | |
|---|---|---|---|---|
| 2006/0189378 | A1 | 8/2006 | Aoki | 463/20 |
| 2006/0287043 | A1 | 12/2006 | Englman et al. | 463/16 |
| 2009/0093298 | A1 | 4/2009 | Michel | 463/20 |
| 2009/0131175 | A1* | 5/2009 | Kelly et al. | 463/42 |
| 2010/0041464 | A1 | 2/2010 | Arezina et al. | 463/22 |
| 2010/0056261 | A1 | 3/2010 | Englman et al. | 463/25 |
| 2010/0069160 | A1 | 3/2010 | Barrett et al. | 463/46 |
| 2010/0222123 | A1 | 9/2010 | Hornik | 463/16 |
| 2010/0234090 | A1 | 9/2010 | Thomas | 463/20 |
| 2010/0234099 | A1 | 9/2010 | Rasmussen et al. | 463/29 |
| 2010/0267439 | A1 | 10/2010 | Englman et al. | 463/20 |
| 2010/0267442 | A1 | 10/2010 | Englman et al. | 463/20 |
| 2010/0279764 | A1 | 11/2010 | Allen et al. | 463/25 |
| 2010/0304830 | A1 | 12/2010 | Englman et al. | 463/17 |
| 2010/0317424 | A1 | 12/2010 | Hornik et al. | 463/20 |
| 2010/0317442 | A1 | 12/2010 | Thomas et al. | 463/42 |
| 2011/0034239 | A1 | 2/2011 | Collette et al. | 463/26 |
| 2011/0045898 | A1 | 2/2011 | Anderson | 463/25 |
| 2011/0065495 | A1 | 3/2011 | Hornik et al. | 463/25 |
| 2011/0070940 | A1 | 3/2011 | Jaffe et al. | 463/20 |
| 2011/0105233 | A1 | 5/2011 | Aoki | 463/42 |
| 2011/0124393 | A1 | 5/2011 | Hornik et al. | 463/20 |
| 2011/0130192 | A1 | 6/2011 | Englman et al. | 463/20 |
| 2011/0201410 | A1 | 8/2011 | Englman et al. | 463/25 |
| 2011/0218034 | A1 | 9/2011 | Barclay et al. | 463/25 |
| 2011/0300926 | A1 | 12/2011 | Englman et al. | 463/25 |
| 2012/0028703 | A1 | 2/2012 | Anderson et al. | 463/25 |
| 2012/0071226 | A1 | 3/2012 | Pacey et al. | 463/20 |
| 2012/0115580 | A1* | 5/2012 | Hornik et al. | 463/25 |
| 2012/0122541 | A1* | 5/2012 | Meyer | 463/19 |
| 2012/0184351 | A1* | 7/2012 | Hornik et al. | 463/25 |
| 2012/0202588 | A1 | 8/2012 | Gagner et al. | 463/25 |
| 2012/0202601 | A1 | 8/2012 | Gagner et al. | 463/42 |
| 2012/0220363 | A1 | 8/2012 | Bytnar et al. | 463/25 |
| 2012/0231868 | A1 | 9/2012 | Guinn | 463/20 |
| 2012/0258790 | A1 | 10/2012 | Gomez et al. | 463/25 |
| 2013/0017885 | A1 | 1/2013 | Englman et al. | 463/25 |
| 2013/0040730 | A1 | 2/2013 | Barclay et al. | 463/27 |
| 2013/0084965 | A1 | 4/2013 | Gura et al. | 463/26 |

* cited by examiner

WAGERING GAME INTERFACE INCLUDING A PLURALITY OF BASE GAMES AND A COMMON VIRTUAL TOP BOX

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, more particularly, to a wagering interface including a plurality of base games and a common virtual top box.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a method in a gaming system includes receiving, via one or more input devices, an input indicative of a wager for a primary wagering game associated with a single player. Play of the primary wagering game is initiated via at least one of the one or more processors. The primary wagering game is displayed in a display area subdivided into a plurality of display regions. The primary game includes a plurality of base games each having an array of symbols. Each of the base games is displayed in a respective one of the plurality of display regions and has a virtual character associated therewith. A simulated top box is displayed in one of the plurality of display regions. The simulated top box includes a secondary game common to at least the plurality of base games. In response to play of the primary wagering game being initiated, an outcome for each of the plurality of base games is determined via at least one of the one or more processors and the outcomes are displayed concurrently in the display area. In response to a bonus trigger, at least two of the plurality of base games are caused via at least one of the one or more processors to combine into a single bonus array of symbols for a bonus game. The single bonus array of symbols is displayed in one or more of the plurality of display regions.

According to another aspect of the invention, a method in a gaming system includes receiving, via one or more input devices, an input indicative of a wager for a primary wagering game associated with a single player. Play of the primary wagering game is initiated via at least one of the one or more processors. The primary wagering game is displayed in a display area subdivided into a plurality of display regions. The primary game includes a plurality of base games each having an array of symbols. Each of the base games is displayed in a respective one of the plurality of display regions and has a virtual character associated therewith. A simulated top box is displayed in one of the plurality of display regions. The simulated top box includes a bonus game common to at least the plurality of base games. In response to initiating play of the primary wagering game, an outcome is determined via at least one of the one or more processors for each of the plurality of base games and the outcomes are displayed concurrently in the display area. In response to a bonus trigger, the virtual character is causes via at least one of the one or more processors to engage in an activity in a virtual world of the bonus game displayed in the simulated top box. The bonus game is a social media game, and at least some of the virtual characters are persistent and further associated with the social media game.

According to yet another aspect of the invention, a computer-implemented method in a gaming system includes receiving, via one or more input devices, an input indicative of a wager for a primary wagering game associated with a single player. Play of the primary wagering game is initiated via at least one of the one or more processors. The primary wagering game is displayed in a display area subdivided into a plurality of display regions. The primary game includes a plurality of base games each having an array of symbols. Each of the base games is displayed in a respective one of the plurality of display regions and has a virtual character associated therewith. A simulated top box is displayed in one of the plurality of display regions. The simulated top box includes a bonus game common to at least the plurality of base games. In response to initiating play of the primary wagering game, an outcome is determined via at least one of the one or more processors for each of the plurality of base games and the outcomes are displayed concurrently in the display area. In response to a bonus trigger, the virtual character is caused via at least one of the one or more processors to engage in an activity in a virtual world of the bonus game displayed in the simulated top box.

According to yet another aspect of the invention, one or more physical machine-readable storage media include instructions which, when executed by one or more processors, cause at least one of the one or more processors to perform the above methods.

Additional aspects of the invention will be apparent to those of ordinary skill in the art in view of the detailed description of various embodiments, which is made with reference to the drawings, a brief description of which is provided below.

Figure 1:
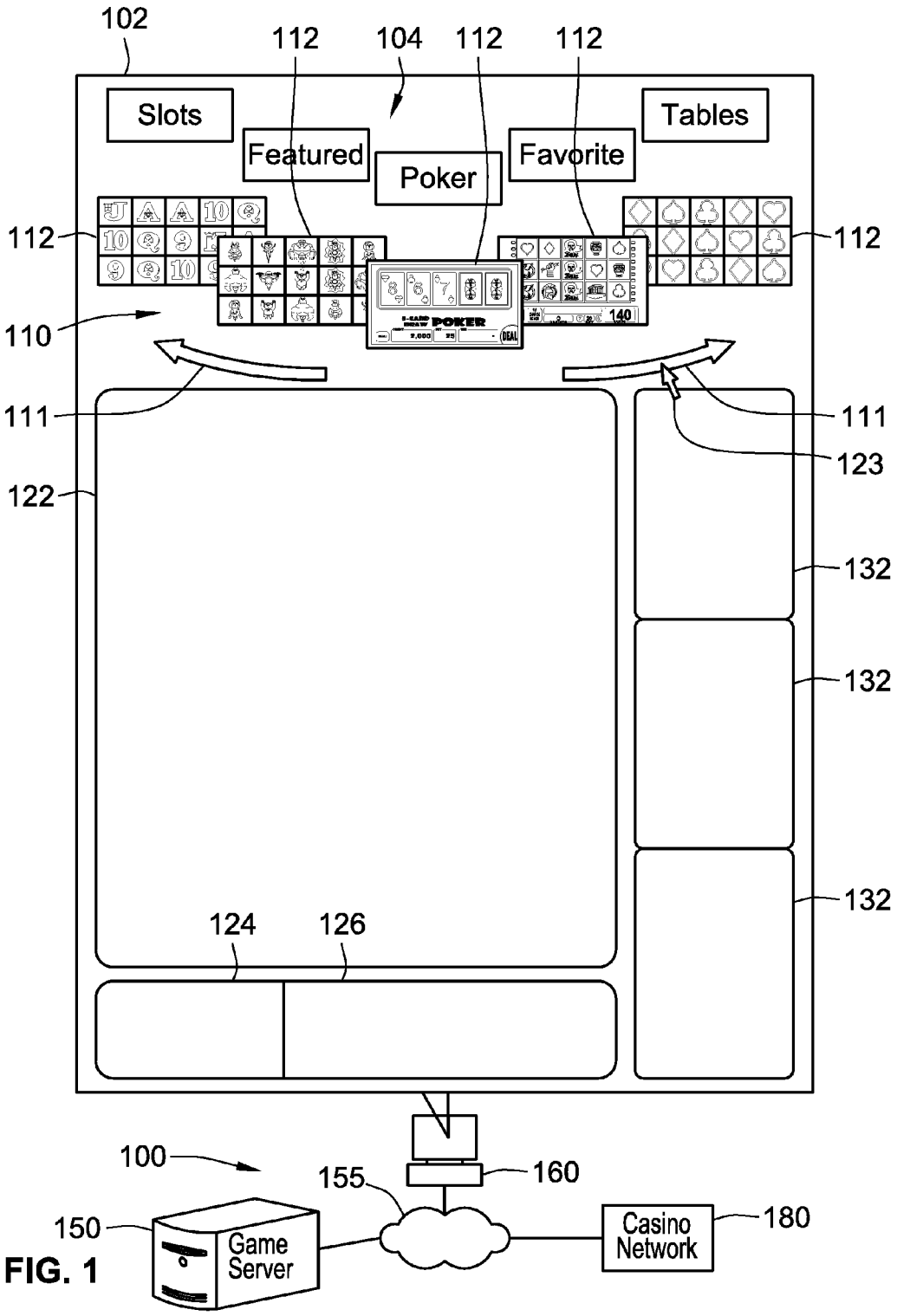
FIG. 1 is a conceptual diagram illustrating a wagering game system architecture including an exemplary interface for selecting base games for a primary wagering game, according to some embodiments.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Wagering game systems offer wagering game players ("players") entertainment value and the opportunity to win monetary value. In some implementations, wagering game systems can try to enhance the gaming experience by offering a multiplay wagering game interface that allows players to play multiple wagering games simultaneously. The multiplay wagering game interface can increase the entertainment value by offering a player a variety of wagering game options and player interactivity features involving multiple games. The multiplay wagering game interface can increase the amount of monetary value a player can win per spin and can increase the odds of winning per spin. The multiplay wagering game experience can be further enhanced through a simulated top box that is common to each of the wagering game options, which may also be referred to as base game. It would also be desirable for a multiplay wagering interface to have a display area including a plurality of the display regions, where in some aspects, one or more display regions display each of a plurality of base wagering games and another display region displays the simulated top box that is common to the plurality of base wagering games.

A multiplay wagering game interface including a common virtual top box display region can be implemented in both online wagering game systems and casino floor wagering game systems. In some aspects, an online wagering game system comprises an online wagering game server presenting the multiplay wagering game interface to a player via a browser on the player's wagering game device that is connected to a network. In another aspect, a casino floor wagering game system comprises a casino wagering game server presenting a multiplay wagering game interface with a common virtual top box display region on one or more wagering game machines on the casino floor.

A multiplay wagering game interface can include a primary wagering game comprising a plurality of base games and virtual top box common to the primary wagering game. Various functionalities and operations can be made available through the wagering game interface. For example, in some aspects the multiplay wagering game interface includes a single display area on a display device for displaying the primary wagering game. The display area is divided into different display regions, at least one of which includes a simulated top box for displaying a secondary game common to a plurality of base games that make up the primary wagering game. Each of the base games are displayed in separate respective display regions also displayed within the display area on the display device. The single display area may comprise a majority (for example, half or greater) to a significant majority (e.g., seventy-five percent or greater) of the display area on a display device. The display device may include LCD, LED, OLED, or similar display devices.

In some aspects, the multiplay wagering game interface may be displayed on a wagering game player's computing device via a remote server hosting a gaming website. The gaming website concurrently presents a primary wagering game, including one or more base games, and a virtual top box in what may be described as a "Casino Matrix" within a single display area. Different combinations of base games can be presented in the display area along with the simulated or virtual top box. It is desirable for the secondary game displayed in the top box to be common to the primary wagering game, and thus, to each of the different base games that make up the primary wagering game.

In some aspects, a player selects the base games that are included in the primary wagering game. The simulated top box that is displayed in the wagering game interface and the player selections of base games in turn can determine the game content or game play for the simulated top box or plurality of base games. It is contemplated that in certain aspects of the multiplay wagering game that determination of the game content or game play based on the player selection of the base games does not cause an adjustment to the selected base games such that the base games are mathematically compatible with each other.

Mathematical compatibility between the base games can be desirable for allowing multiple base games with different features to be interchangeable and further allow for various combinations of base games by a player. For example, each of a plurality of base games may have the same expected value (e.g., 90 percent), and each may also have the same bet amount (e.g., 40 credits). The first base game may include a symbol on a certain reel (e.g., reel 5) that activates a first virtual character in a secondary game displayed in a simulated top box display that is common to the plurality of base games. The symbol associated with the first virtual character might appear frequently and thus contribute a high percentage (e.g., 25 percent) of the total expected value (e.g., 90 percent) for the game. The remainder of the first base game then awards the remaining expected value (e.g., 90 minus 25 or 65 percent). A second base game may include a symbol on the certain reel (e.g., reel 5) that activates a different or second virtual character in the secondary game displayed in the simulated top box. The symbol associated with the second virtual character may appear much less frequently than the symbol associated with the first virtual character, but the second virtual character has the potential for large awards in the bonus game, and thus, may contribute only a slightly lower percentage (e.g., 20 percent) of the total expected value (e.g., 90 percent) for the game than the first virtual character does for the first base game. Similarly, the remainder of the second base game then awards the remaining expected value (e.g., 90 minus 20 or 70 percent). A third game of the plurality of base games may include a symbol on the certain reel (e.g., reel 5) that activates yet another or a third virtual character in the secondary game displayed in the simulated top box. The symbol for the third virtual character may appear more frequently (e.g., every spin) but may not contribute much (e.g., 10 percent) of the total expected value (e.g., 90 percent) when compared to the first and second virtual characters. Similarly, the remainder of the third base game then awards the remaining expected value (e.g., 90 minus 10 or 80 percent).

As discussed above, it is contemplated that the plurality of base games (e.g., the first, second, and third base games) are all compatible, and the overall expected value stays the same (e.g., 90 percent), no matter how the base games are combined. However, in some aspects, it is contemplated that the expected value of the bonus game may be changed when the plurality of base games are combined differently. The base games can further be interchangeable, and a player may select multiple versions of the same base game and play them at the same time. It is therefore contemplated that some incompatibilities may be accounted for through adjustments to the math of the bonus or base games. For example, a possible incompatibility could occur if features from each base game are not independent and create a different payback when combined than when the base games are played alone. This may happen if a feature is combined that adds wild symbols to the reels and another feature makes certain symbols wild. The result will be compounded when the two features are combined, and can create a game where certain combinations of base games would have a better payback than others. In this case, the bonus or the base games can adjust their math to balance the impact of the compounded features and thus maintain compatibility. TO accomplish this, the wagering game may maintain multiple math files that would be accessed based on the player's base game selections.

Turning now to FIG. 1, a conceptual diagram is illustrated of an exemplary multiplay wagering game interface in a wagering game system, according to some aspects. A wagering game system ("system") 100 includes an online game server 150 connected to an online wagering game device ("gaming device") 160 via a communications network 155. As illustrated, the online game server 150 can present a multiplay wagering game interface on the gaming device 160 via a browser of the gaming device 160. In some aspects, the online game server 150 can connect to a casino network 180, including one or more casino network devices, such as wagering game servers, account servers, wagering game machines, or other devices (not shown). In some implementations, the wagering game servers in the casino network 180 can also present a multiplay wagering game interface on the wagering game machines in the casino network 180.

In some aspects, it is contemplated that the communication network 155 includes additional servers (not shown), such as a social media server or a non-wagering game server, communicatively connected to the wagering game system that also interact, directly or indirectly, with the online wagering game device 160. The additional servers can optionally be connected to the game server 150 or the casino network 180, which act as gateways to the online wagering game device 160 and coordinate or control a player experience with content (e.g., social media games, non-wagering games) available from the additional servers.

A multiplay wagering game can include a separate primary game selection interface 102 to allow player selection of the plurality of base games. The interface 102 can be arranged as a game carousel 110 or some other logical selection mechanism that presents a plurality of base wagering game icons 112 to the player via the interface 102. It is contemplated that the interface 102 may be a window of a multiplay wagering game interface or the interface 102 may be presented as a full-screen on a display device. The primary game selection interface 102 may be displayed in response to a player entering the multiplay wagering game, a player selecting an icon or indicia on a main-screen of a multiplay wagering game interface, or a player otherwise making a selection causing the primary game selection interface to be displayed.

The game carousel 110 may display a subset of the available base wagering game icons 112. For example, one of the wagering game icons may be displayed in a center position, with two wagering game icons displayed to the left of the center position and two wagering games icons displayed to the right of the center position. The wagering game icons to the left and right of the center position can be staggered to simulate a virtual carousel that disappears into the screen or can include the icons partially overlaying an adjacent icon. A player can scroll through all the available wagering game icons 112 by selecting the arrows 111 of the game carousel 110. When the player selects (e.g., via a mouse, touch screen, other selection device) the left arrow 111, the game carousel 110 rotates the wagering game icons 112 by one position to the left, and when the player selects the right arrow 111, the game carousel 110 rotates the wagering game icons 112 by one position to the right. In one aspect, if a player selects and holds one of the arrows 111, the game carousel 110 rotates in the corresponding direction until the player releases the arrow.

In some aspects, players can rotate the game carousel 110 or alternate game icon selection feature, select base wagering game icons 112, and otherwise interact with the game selection interface 102 using a pointer 123. The pointer 123 can be controlled by various mechanisms, e.g., a mouse, a joystick, a touch sensor pad, etc. It is noted, however, that in some implementations players can interact with the primary wagering game selection interface 102 by various other input mechanisms, e.g., a touch screen or voice control.

It is contemplated that other aspects of a primary wagering game selection interface 102 include presenting the available base games to players via other mechanisms. For example, instead of the carousel 110, the interface 102 can display all the available base game icons in columns and rows above the game builder window 122. In another example, the interface 102 can display the title of the available wagering games for selection by the user, e.g., via a drop down list on a menu bar. The described carousel and other concepts are but one of many ways the different base game icons may be displayed. In some aspects, the game icons may further be displayed in a linear or circular manner.

The interface 102 can further include game menu buttons 104. The game menu buttons 104 can control the type of games that are displayed in the game carousel 110, or otherwise, for selection by a player. The player can also select multiple game menu buttons 104 to display a combination of game types. In one example, the wagering game selection window 102 includes game menu buttons for slot games, table games, video poker, favorite games, and featured games. Activating the favorite games menu button may cause the interface 102 to display wagering games that a particular player has played most (i.e., based on historical information) and/or games that the player has tagged as a favorite wagering game (i.e., customization option). In one example, the player can customize the wagering games that are included in the favorite game menu button by selecting the button. The featured game menu button can display new games, updated games, games with promotional offers, games currently offering the highest jackpots, etc. In one example, casino or game server operators can select which games appear in the featured game menu button.

In some aspects, the primary game selection interface 102 includes a game building window 122 which may be a display region of a display area (e.g., interface 102) where a player builds their primary wagering game based on one or more selections of the available base game icons 112. The interface 102 may also include a plurality of configurable player windows 132 that can be set or customized by a player to display a variety of casino-related features, such as game-related chat rooms, player profiles, rankings of casino jackpots, casino promotions and other advertisements, etc. The configurable player windows 132 can also be used to display other information, e.g., information from the Internet, such as financial information, news, sports, etc. In some implementations, the configurable player windows 132 can also be used by the game server to display communal games and bonus games.

In some implementations, one or more of the player configurable windows 132 can include the display of a virtual character associated with a selected base game determined by a player's selection from one of the plurality of base game icons 112. It is further contemplated that while configurable player windows 132, such as those with the variations described herein, may be displayed in interface 102 (shown), player configurable windows can also be displayed in separate display regions of a gameplay interface for a primary wagering game that includes one or more display regions for displaying the play of all the selected base games and a simulated top box common to the plurality of base games. For example, a gameplay interface such as the interface 602 illustrated in FIG. 6 may also include separate display regions (not shown) including one or more configurable window such as those described for FIG. 1.

Figure 2:
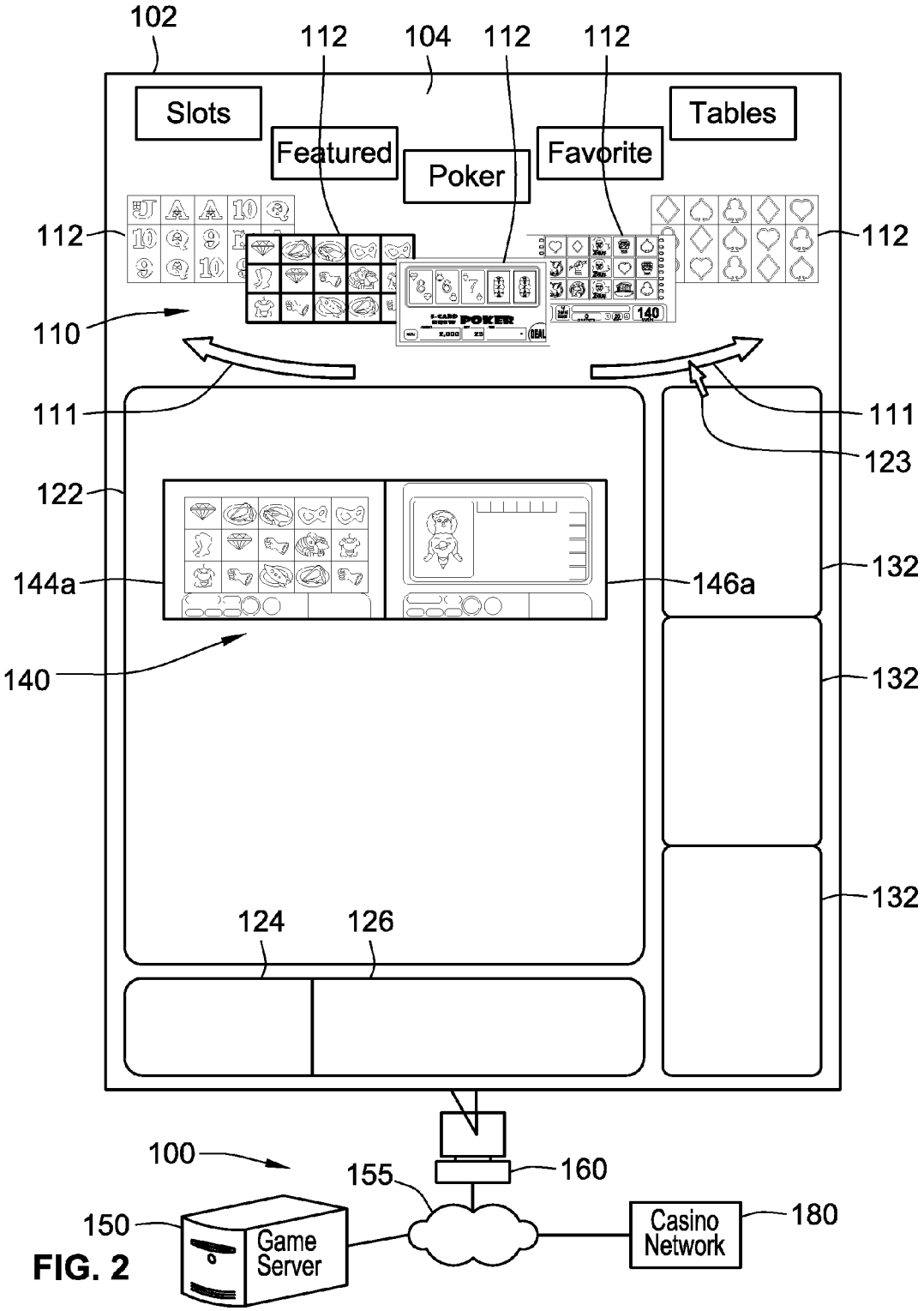
FIG. 2 is a conceptual diagram illustrating a wagering game system architecture including an exemplary interface for selecting an instance of a base game from a game selection window, according to some embodiments.
Figure 3:
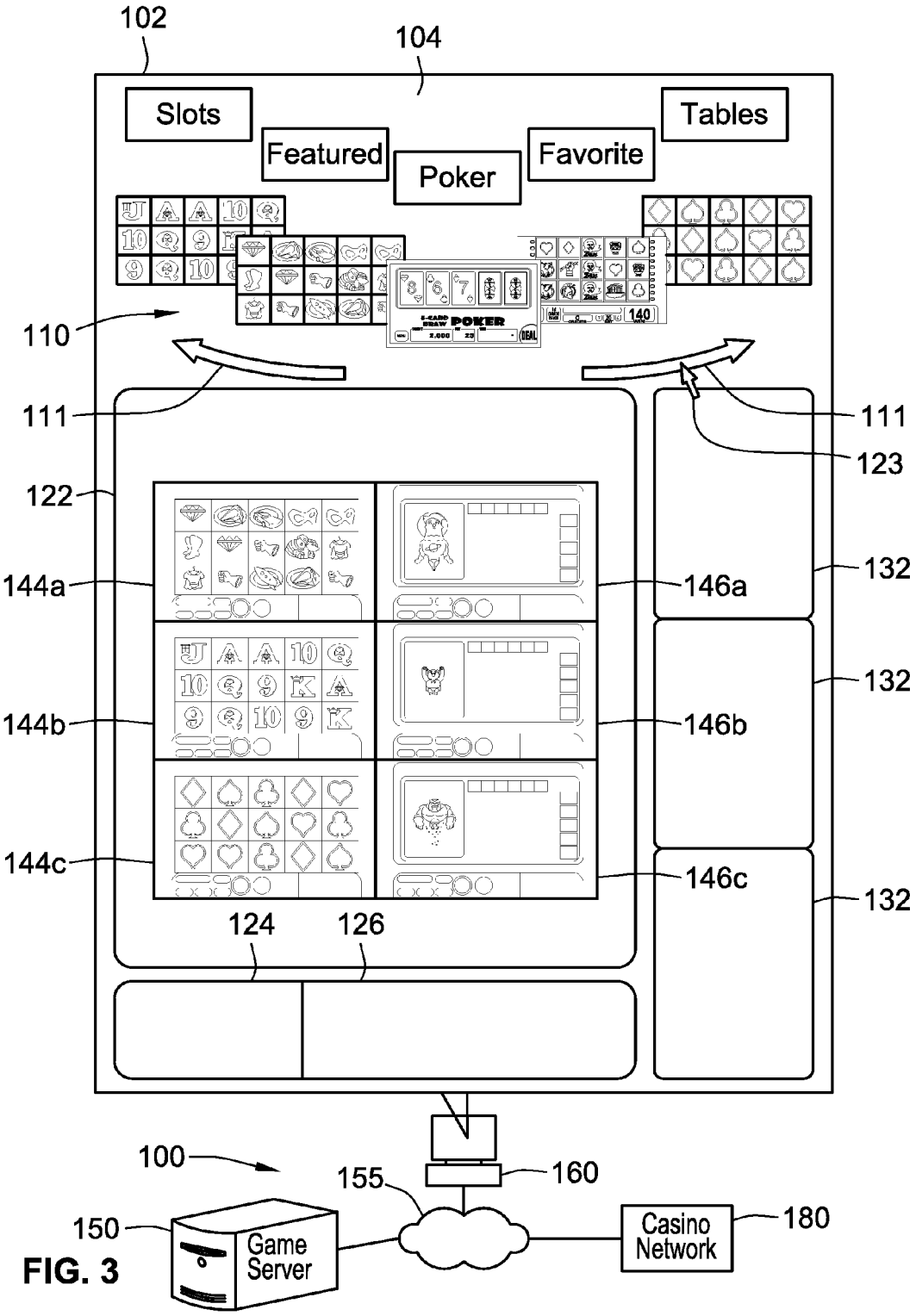
FIG. 3 is a conceptual diagram illustrating a wagering game system architecture including an exemplary interface for selecting additional instances of a base game from a game selection window of the wagering game interface, according to some embodiments.

Referring now to FIGS. 2 and 3, an exemplary implementation of a primary wagering game selection interface 102 is illustrated for a base game selection process where the system receives player selection(s) of one or more of the base wagering game icons 112. In some aspects, a player may rotate the game carousel 110 until a desired wagering game icon 112 is at the center position. Then, the player may drag and drop the selected game from the game carousel 110 to the game builder window 122, e.g., using the pointer 123. In another exemplary aspect, the player may drag and drop any of the visible game icons 112 regardless of the position within the game carousel 110. It is noted, however, that the wagering game icons 112 can be selected by various other methods. For example, in addition to the drag and drop functionality, the interface 102 can allow the player to select a desired wagering game by double-clicking the corresponding wagering game icon 112 or selecting the icon via a touch-screen display or selecting from a mechanism other than a carousel.

In response to receiving a selection a base game icon 112 or one of a plurality of base game icons, the game selection interface 102 provides information associated with the selected icon(s) to the wagering game server 150. The gaming device 160 presents media for the selected wagering game within the base game builder window 122 of the interface 102. If the base wagering game is the first wagering game within the builder window 122, the gaming device 160 may scale the base wagering game to fit the entire builder window 122. If the wagering game is not the first base game within the builder window 122, the gaming device 160 scales the existing wagering game and the newly selected base game to fit all of the base games within the builder window 122. In one exemplary implementation, the base games are automatically scaled when the player selects (e.g., drags and drops) a new base game and the new base game is presented within the builder window 122. Depending on the selection by the player, the interface 102 can present multiple instances of the same base game or a single instance of each selected different base games, or some combination thereof.

In some aspects, in response to receiving selection(s) of base wagering game icon(s) 112, the selection interface 102 provides selection information to the game server 150, or another server associated with the communications network or game server. Following receipt by the gaming device 160, the media 140 for the selection can be presented as base game media 144*a* within the base game builder window 122 of the interface 102 for the selected base game. Each base game may also have a virtual character associated therewith, such as a superhero or other character that may also be customizable, and the gaming device 160 can also present the associated virtual character media 146*a* for the selected base game within the base game builder window 122 of the interface 102.

In response to receiving additional selections of base wagering game icons 112, the selection interface 102 provides the additional selection information to the game server 150, or another server that is associated with the communications network or game server. Following receipt by the gaming device 160, the media 140 for the selection is presented in the base game builder window 122 of the interface 102 as base game media 144*a* for the selected base game. As discussed above, each base game may also have a virtual character associated therewith and the gaming device 160 can also present virtual character media 146*a* for the selected base game.

An exemplary aspect of game selection interface 102 is illustrated in FIG. 3 where in response to received selections of various base wagering game options, the received selections result in associated base game media (e.g., 144*a*, 144*b*, 144*c*) being displayed in the base game builder window 122 of interface 102. In the example illustrated in FIG. 3, the exemplary gaming device 160 displays three base games to the player based on game selection inputs received by the gaming device via the player. In the illustrated example, the gaming device 160 presents three instances of different themed slots games. However, it is contemplated that more or fewer base games may be selected, including base games of different themes and different types.

In some aspects, each of the base games is associated with a virtual character. The virtual character may be unique for each base game. The virtual character can also, for example, vary depending on, the base game theme, base game type, customized player selections, or stored customized virtual character information. For example, virtual character media (e.g., 146*a*, 146*b*, 146*c*) is associated with respective selected base games and can be displayed next to the base game media (e.g., 144*a*, 144*b*, 144*c*). The virtual character media may also include displaying or presenting features for the virtual character that are customized, for example, according to player preferences. The features that customize a character may be selected by a player based on selections received via a virtual character editor (see, for example, the Hero Editor window in FIG. 7). In some aspects, similar to base game media, virtual character media may also be received by the game device 160 from the game server 150, or from another server connected to or associated with the communications network 155 or game server 150.

In some aspects, the game selection interface 102 can also include a betting button panel 124 and a common button panel 126 with buttons that are common to each of the selected base games. The betting button panel 124 may display betting options for the selected games. For example, the betting button panel may allow a player to customize bets for each individual base game before proceeding to a gameplay interface where play of all the base game is initiated simultaneously or near simultaneously. It is also contemplated that the betting button panel 124 displays betting options common to all the selected base game. The game selection interface 102 may also provide for the common button panel 126 that displays control buttons common to all of the selected games (e.g., a spin button) and may be displayed as part of the interface 102 should game play also occur on interface 102. It is also contemplated that a common button panel may also be displayed on another game play interface as discussed, for example, for FIG. 6.

As generally described above, for example, in the context of FIGS. 1-3, a multiplay wagering game interface with a simulated top box common to a plurality of base games can be implemented in different operating environments. For example, a wagering game system architecture 100 can also include an account server (not shown) that is connected to communications network 155, either directly or indirectly (e.g., through the game server, casino server, or another server), where the account server is configured to control user related accounts accessible via wagering game networks. The account server can manage player financial accounts (e.g., performing funds transfers, deposits, withdrawals, etc.) and player information (e.g., avatars, screen name, account identification numbers, social contacts, financial information, etc.). The account server can also provide auditing capabilities, according to regulatory rules, and track the performance of players, machines, and servers. The account server can include an account controller configured to control information for player accounts. The account server can also include an account store configured to store information for player accounts.

The wagering game system architecture 100 can also be configured to include an online game server 150 operative to control wagering game content, provide wagering game results (e.g., random numbers), and communicate wagering game information, account information, and other information to and from a gaming device 160. The online game server 150 can include a content store containing content for presenting game results and other events on the gaming device 160. The online game server 150 can also include an account manager configured to control information related to player accounts. For example, the account manager can provide wager amounts, game results amounts (e.g., win amounts), bonus game amounts, etc., to the account server. The online game server 150 can also include a communication unit configured to communicate information from the server's components to the gaming device 160, other systems, devices, and networks (e.g., the casino network 180). For example, the communication unit can exchange information with community wagering game servers, account servers, community servers, social networking servers, file sharing servers, etc.

The online game server 150 can also be configured with a wagering game controller operative to facilitate presentation of wagering games on the gaming device 160. For example, the wagering game controller can generate and provide game results (e.g., random numbers) to the gaming device 160. In some instances, the wagering game controller provides multiple game results so the gaming device 160 can contemporaneously present multiple wagering games.

An online game server 150 can further include a bonus game or secondary game controller configured to manage bonus or secondary games. For example, in response to detecting a bonus game trigger event, the bonus game controller can determine bonus game results for presentation on an interface or window, such as the windows and interfaces illustrated in FIGS. 8-12.

The game system architecture 100 can also include the gaming device 160 being configured to present wagering games and receive and transmit information to control and present online wagering games. The gaming device 160 can include a content controller configured to manage and control content and presentation of wagering games on the gaming device 160. The gaming device 160 can also include a content store configured to store content to present on the gaming device 160. The gaming device 160 may further include a presentation controller configured to control the presentation of the wagering game and bonus game content on the gaming device 160. The presentation controller can include a web browser, browser plug-ins, and any other software and/or hardware suitable for presenting audio and video content. In some aspects, the presentation controller presents game results using content stored locally in the content store. However, in some instances the presentation controller may receive, from the server 150, content for presenting game results, or the controller may request particular content from other network devices. The gaming device 160 can also include processing components (e.g., microprocessor, memory, bus, etc.) configured to operate in concert with the gaming device's other components.

The game system architecture 100 can also include a casino network 180 comprising a casino wagering game server and a plurality of wired and/or wireless wagering game machines. Similar to the online game server 150, the casino wagering game server can include a content store, an account manager, a communication unit, a wagering game controller, and a bonus game controller to control wagering game content, provide wagering game results (e.g., random numbers), communicate wagering game information, account information, and other information to and from the one or more wagering game machines.

The component(s) shown in the game system architecture 100 are shown as separate and distinct elements connected via a communications network 155. Other described components that may not be illustrated or that may be a part of one of the illustrated components (e.g., game server 150, gaming device 160, casino network 160) can also in some aspects of the game system architecture be separate and distinct elements connected to and communicating though the communications network 155. In addition, operations executed by one component can also be executable by other components. Furthermore, the described components may be contained in one device, but some, or all, may be included in, or performed by multiple devices. The wagering game system architecture 100 can further be implemented as software, hardware, combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

In some aspects, the gaming device 160 can include a device primarily dedicated for use in conducting wagering games, or may include non-dedicated devices, such as mobile phones, personal digital assistants, personal computers, etc. Exemplary types of gaming devices and other exemplary aspects associated with the gaming system are disclosed in U.S. Pat. No. 6,517,433, titled "Reel Spinning Slot Machine With Superimposed Video Image"; U.S. Patent Application Publication No. US2010/0069160, titled "Handheld Wagering Game Machine And Docking Unit"; U.S. Patent Application Publication No. US2010/0234099, titled "Wagering Game System With Docking Stations"; U.S. Patent Application Publication No. 2011/0218034, titled "Multiplay Wagering Game Mechanism"; and U.S. Patent Application Publication No. US2012/0220363, titled "Gaming Terminal with Adjustable Display", each of which are hereby incorporated by reference herein in their entireties.

Figure 4:
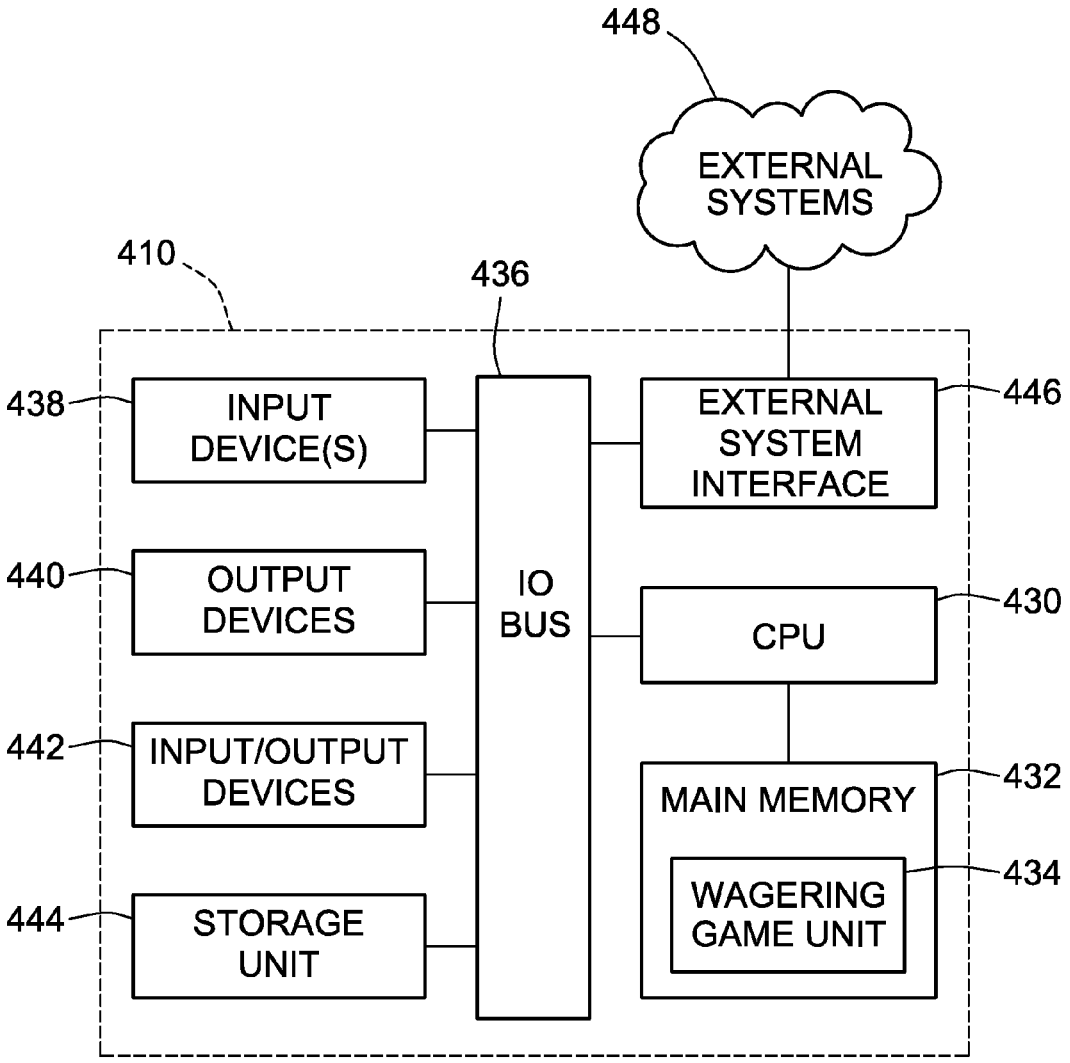
FIG. 4 is a schematic view of an exemplary gaming system, according to some embodiments.

Referring now to FIG. 4, a block diagram of an exemplary aspect of at least a portion of a wagering game architecture is illustrated according to some aspects of the present disclosure. A gaming machine 410 or elements comprising a wagering game architecture can include a central processing unit (CPU) 430 connected to a main memory 432. The CPU 430 may include any suitable processor(s), such as those made by Intel and AMD. By way of example, the CPU 430 includes a plurality of microprocessors including a master processor, a slave processor, and a secondary or parallel processor. CPU 430, as used herein, comprises any combination of hardware, software, or firmware disposed in or outside of the gaming machine 410 that is configured to communicate with or control the transfer of data between the gaming machine 410 and a bus, another computer, processor, device, service, or network. The CPU 430 comprises one or more controllers or processors and such one or more controllers or processors need not be disposed proximal to one another and may be located in different devices or in different locations. The CPU 430 is operable to execute all of the various gaming methods and other processes disclosed herein. The main memory 432 can include a wagering game unit 434. In one embodiment, the wagering game unit 434 may present wagering games, such as video poker, video blackjack, video slots, video lottery, etc., in whole or part.

The CPU 430 can also be connected to an input/output (I/O) bus 436, which can include any suitable bus technologies, such as an AGTL+frontside bus and a PCI backside bus. The I/O bus 436 is connected to various input devices 438, output devices 440, and input/output devices 442 such as those discussed for the game interfaces or gaming device described elsewhere herein. The I/O bus 436 is also connected to storage unit 444 and external system interface 446, which is connected to external system(s) 448 (e.g., wagering game networks, communication networks, casino networks).

The external system 448 can also include, in various aspects, a gaming network, other gaming terminals, a gaming server, a remote controller, communications hardware, or a variety of other interfaced systems or components, in any combination. In yet other aspects, the external system 448 may comprise a player's portable electronic device (e.g., cellular phone, electronic wallet, etc.) and the external system interface 446 is configured to facilitate wireless communication and data transfer between the portable electronic device and the CPU 430, such as by a near-field communication path operating via magnetic-field induction or a frequency-hopping spread spectrum RF signals (e.g., Bluetooth, etc.).

The gaming machine 410 optionally communicates with the external system 448 such that the machine operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming machine 410 ("thick client" gaming terminal), the external system 448 ("thin client" gaming terminal), or are distributed therebetween in any suitable manner ("intermediate client" gaming terminal).

The gaming machine 410 may include additional peripheral devices or more than one of each component shown in FIG. 4. Any component of the gaming system architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 5:
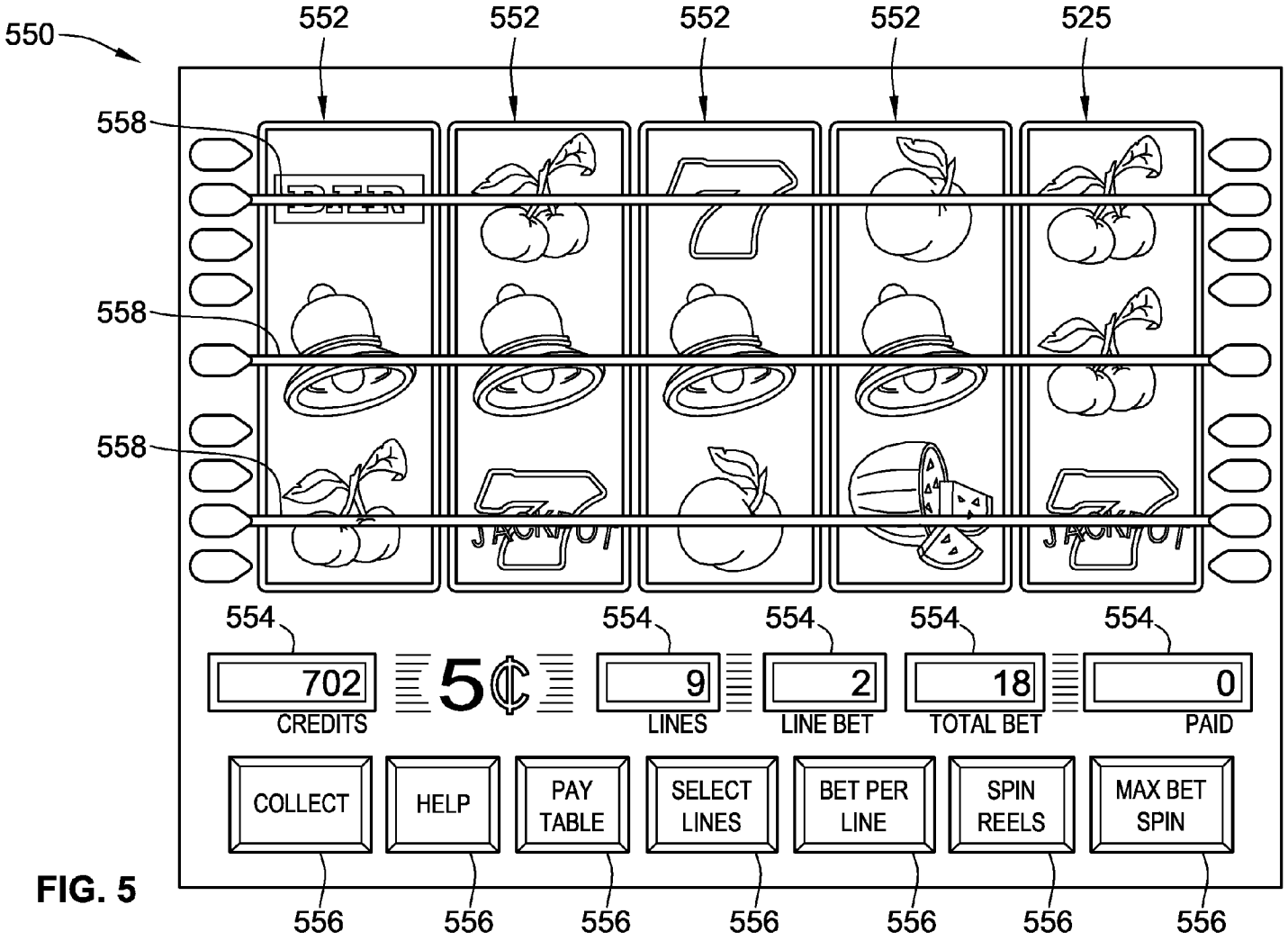
FIG. 5 is an image of an exemplary base game displayed in a display region of a wagering game interface, according to some embodiments.

Referring now to FIG. 5, an image of an exemplary base game media displayed in a display region of a wagering game interface is illustrated according to some aspects of the present disclosure. The exemplary base game window 550 portrays a plurality of simulated symbol-bearing reels 552. The base game window 550 also advantageously displays one or more game-session credit meters 554 and various selectable (e.g., touch screen, pointer) buttons 556 adapted to be actuated by a player. In some aspects, the displayed buttons may be exclusive to the exemplary base game or the buttons may be common to the plurality of selected base games. A player can operate or interact with the wagering game using these touch screen buttons or other input devices disclosed herein. The CPU operate(s) to execute a wagering game program causing the wagering game interface with the exemplary base game to be displayed in a display area on a display device.

In response to receiving an input indicative of a wager for a primary wagering game including the plurality of base game, the reels 552 on an exemplary base game are rotated and stopped to place symbols on the reels in visual association with paylines such as paylines 558. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggers, such as bonus triggering symbol(s) appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a primary wagering game on a gaming system in accord with the present concepts, the primary wagering game includes a game sequence in which a player makes a wager associated with the plurality of base game and an outcome is provided or displayed for each of the base games in response to the wager being received or detected. The outcomes are then revealed to the player in due course following initiation of the primary wagering game. The method comprises the acts of conducting the wagering game using a gaming apparatus following receipt of an input from the player to initiate the wagering game. The gaming apparatus then communicates the wagering game outcome(s) to the player via one or more output devices (e.g., video display) through the display on an interface of information such as, but not limited to, text, graphics, static images, moving images, etc., or any combination thereof. In accord with the method of conducting the wagering game, the CPU transforms a physical player input, such as a player's pressing of a "Spin Reels" of "Spin All Reels" touch key, into an electronic data signal indicative of an instruction relating to the wagering game (e.g., an electronic data signal bearing data on a wager amount).

In the aforementioned aspect, for each data signal, the CPU (e.g., CPU 430, processor on game server) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 444), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 6:
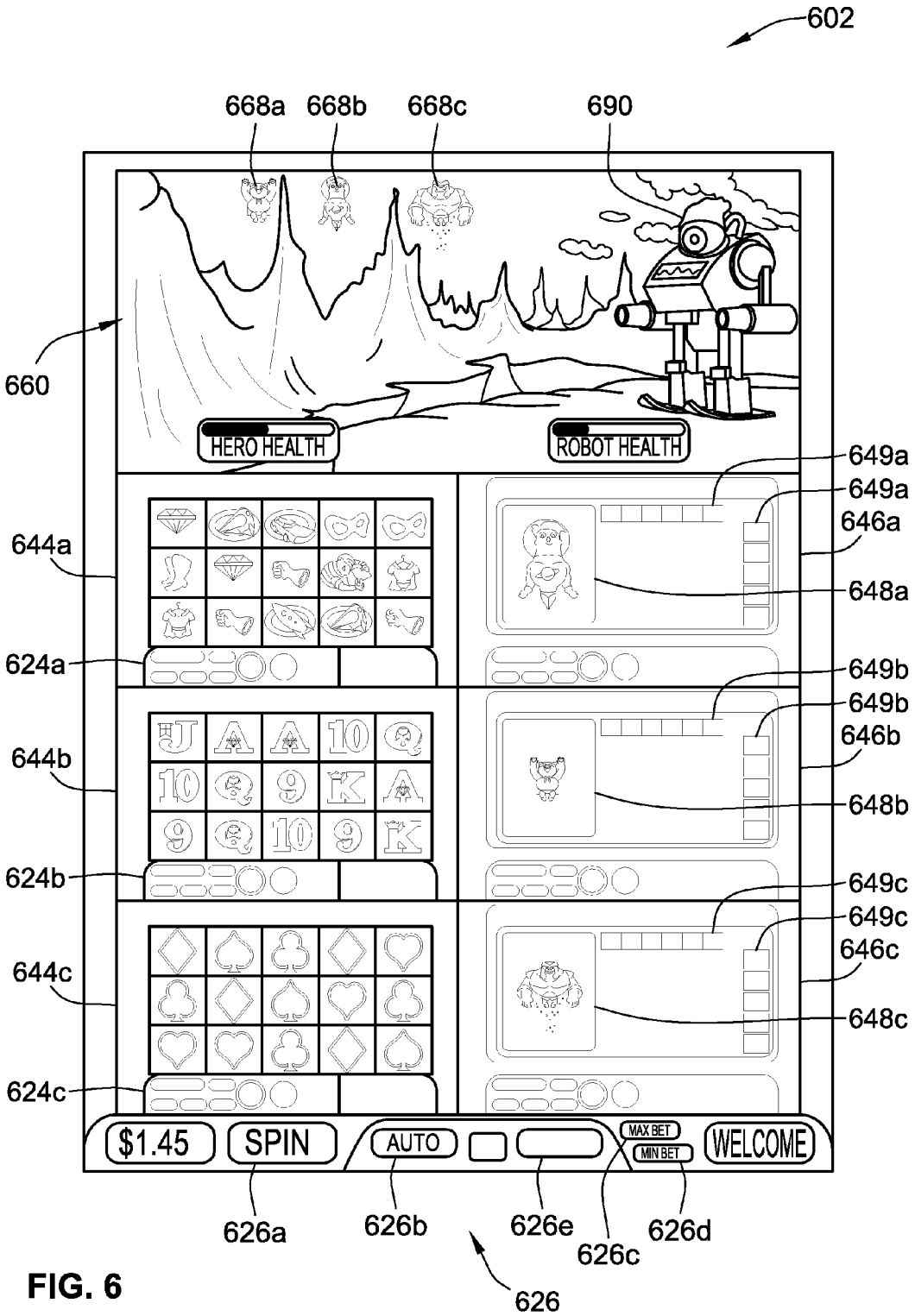
FIGS. 6 and 7 are conceptual diagrams that illustrate an exemplary primary wagering game on a wagering game interface including a plurality of base games and a common virtual top box, according to some embodiments.

Referring now to FIG. 6, an exemplary wagering game interface 602 is illustrated that can be displayed on a gaming device, such as device 160 described earlier for FIGS. 1-3. The interface 602 may define the entire or a substantial portion of a display area on the display device or a smaller portion or window of another interface. For example, following the selection of base games in the game builder window 122 illustrated in FIGS. 1-3, the game builder window 122 may be transformed into a game interface for play of a primary wagering game including the base game and the associated bonus and/or secondary games. In some aspects the wagering game interface 602 may comprise substantially the entire display area of a display device. In some implementations, the wagering game interface 602 is displayed in a display area of the gaming device 160 following the receipt of selections from a base game builder interface. After a player has developed a customized primary wagering game that includes a plurality of base games with each including a unique virtual character (e.g., superhero), the gaming device through content received from the game server 150 over the communications network 155, proceeds to present the wagering game interface 602 on a display of a gaming device.

In some aspects, the interface 602 includes the display of a primary game common panel 626 that may include different buttons, such as a spin button 626*a*, auto-play button 626*b*, maximum bet button 626*c*, and a minimum bet button 626*d*. The spin button 626*a* can be configured to spin or initiate play of all the selected base games that are included in the primary wagering game. The auto-play button 626*b* may initiate automatic play of the primary wagering game. The maximum bet and minimum bet buttons 626*c*, 626*d* may respectively cause the wager for the primary game to be the maximum or minimum bet allowed for a particular game.

It is contemplated that additional betting-related buttons may be displayed in the common panel or within individual betting button panels (e.g., 624*a*, 624*b*, 624*c*) specific to the plurality of base games (e.g., 644*a*, 644*b*, 644*c*) included in the primary wagering game displayed on a wagering game interface, such as interface 602. For example, the interface 602 can display in the common panel 626 or in the individual button panels (e.g., 624*a*, 624*b*, 624*c*) a "change denom" (change denomination) button, a "change bet" button, and a "change lines" button. It is also contemplated that the common panel may include a "betting" button 626*e* that toggles of switches between each of the individual betting panels (e.g., 624*a*, 624*b*, 624*c*) when the button 626*e* is selected and may also cause each of the individual betting panels to be highlighted or increased in size (e.g., via an overlay) to expand within the game interface 602 to allow easier viewing and selections by a player. In another example, a touch screen or pointer may be used to receive selection(s) made within the borders of a betting button panel and causes the selected betting panel to expand in size or be otherwise highlighted so that a player can similarly modify the available betting options (e.g., denomination, bet, pay lines).

In some aspects, it is also contemplated that betting panel(s) may be a part of a common panel, separated from the individual display region for the base games. For example, a common betting panel may be displayed where a player can toggle or switch between each base game such that the common panel displays the associated bet settings for the respective base game. A player may then toggle or switch to another base game such that the bet settings for the another base game are then displayed in the common panel in the same or similar location as the previously selected base game. In some aspects, the bet settings may be the same for each of the base games where any modifications made to a common panel cause a change to the bet settings for each of the base games that comprise the primary wagering game.

The buttons within a betting button panel and a common button panel can be customized based on the type of base games displayed in the interface 602. For example, if the interface 602 displays both slots and video poker base games, the "spin" button can be changed to a "start" button and additional buttons can be added, e.g., a "fold" button. The interface 602 can also display additional information, such as the total balance, total bet amount, and win amount within the betting button panel(s) or the common button panel 626. In some implementations, to enter a bet for each of the displayed base games, the player selects one of the instances of the base games. In response to the selection, a gaming device (e.g., 160) highlights the selected instance of the base game and highlights the betting button panel within the interface 602. After the player enters the betting information for some or all of the displayed base games, the gaming device may highlight the common panel 626 of the interface 602. The player can then select the spin (or start) button 626*a*, and in some cases also the auto play button 626*b*, in the common panel 626. In response to the player selecting the spin or start button, play of the base games occurs and outcomes are displayed for each of the base games. In some aspects, the online wagering game server (e.g., 150) determines results for the base games with the gaming device 160 displaying the outcomes received from the server over the communications network. However, in other embodiments, the operations for presenting base games may be divided between the gaming device (e.g., 160), online gaming server (e.g., 150), or other servers.

It is contemplated that the game server may also present other casino-related services or other information via the gameplay interface 602 or the game builder interface 102 based on input from the player. In one example, the player may modify configurable player window(s) 132 by double-clicking or selecting a window (or by clicking on a configuration button on the interface). Then, the player may be provided with a variety of different configuration options (e.g., player profile, chat room, rankings of casino jackpots, news, etc.). In another example, various gaming-related services can be presented to the player as configuration options for the configurable player windows. While not specifically illustrated in FIG. 6, in some aspects configurable player windows(s) may be a part of the wagering game interface, such as interface 602. For a wagering game interface, similar to the base game builder interface, configurable window(s) can be display regions within a larger display area of the interface 602 and can also be maximized, minimized, or otherwise changed in size, to increase or decrease the size of the other display regions of the interface 602.

Each of the base games in a primary wagering game can be associated with a virtual character unique to each base game. For example, each base game window (e.g., 644*a*, 644*b*, 644*c*) displayed in interface 602 may have an associated window (e.g., 646*a*, 646*b*, 646*c*) displaying the characteristics of the virtual character associated with the respective base game. The characteristics window (e.g., 646*a*, 646*b*, 646*c*) can be displayed adjacent to its respective base game window or elsewhere within interface 602. Furthermore, the characteristics window may be continually displayed, or it may be displayed at certain intervals during game play. For example, display of the characteristics window can be limited to periods associated with a bonus game, activity occurring in a simulated top box relating to the virtual character associated with a respective characteristic window, or base on a player option of when the characteristic window is displayed.

The characteristic windows may further include additional windows such as character windows 648*a*, 648*b*, 648*c* for displaying the virtual character associated with the adjacent base game. The displayed virtual character in window 648*a-c* can be customized according to different player-selected characteristics. Different selectable characteristics for a virtual character can include, among other things, the characters outfit, weapons, defenses, or special powers that might be available to a virtual character. The characteristics may be displayed on the virtual character within the character window (e.g., 648*a-c*) or the characteristic selection(s) or option(s) may also be displayed as icon(s) (e.g., 649*a*, 649*b*, 649*c*) in the characteristic window (e.g., 646*a*, 646*b*, 646*c*). It is also contemplated that some or all of the characteristics of a virtual character may be determined randomly (e.g., based on outcomes during game play), achieved by a player through the accrual of non-monetary points redeemable for various characteristics, or accrued as items are "picked" up (e.g., a player lands on items, maneuvers to come into contact with it, selects it as part of a picking game) by a player during game play.

A simulated top box 660 is also displayed in a display region within interface 602. The simulated top box 660 includes a secondary game that is common to the plurality of base game. The secondary game displayed in the common top box can include the display of each of the virtual characters (e.g., 668*a*, 668*b*, 668*c*) associated with the respective characteristic windows (e.g., 646*a*, 646*b*, 646*c*) for active base games.

As generally described above, a wagering game interface, such as interface 602, may be displayed on a gaming device, such as gaming device 160. The interface may be displayed in a display area subdivided into a plurality of display regions where each display region includes one of a plurality of base games and a separate display region includes a simulated top box for a secondary game common to the plurality of base games. The display area can be part of or the entire display of a video display. In some aspects, the display area includes additional display regions for the display of other information such as information associated with wagering games, non-wagering games, social media games, community games, progressives, advertisements, services, premium entertainment, text messaging, emails, alerts, announcements, broadcast information, subscription information, etc. appropriate to a particular mode(s) of operation of a gaming device. The gaming device can include a touch screen(s), buttons on a button panel or keyboard, information reader/writer(s), and player-accessible port(s) (e.g., audio output jack for headphones, video headset jack, USB port, wireless transmitter/receiver, etc.). It should be understood that numerous other peripheral devices and other elements exist and are readily utilizable in any number of combinations to create various forms of a gaming device in accord with the present concepts.

Input devices on the gaming device, such as a touch screen, buttons, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Exemplary aspects of the association between the base games and the common secondary game displayed in the simulated top box 660 are illustrated in FIG. 6 through the base game windows (e.g., 644*a*, 644*b*, 644*c*) and their respectively associated virtual characters (e.g., 668*a*, 668*b*, 668*c*) which are presented in an inactive state in the secondary game. The secondary game in the simulated top box 660 includes exemplary virtual characters, illustrated as superhero characters that fight a villain character, such as a virtual robot character 690. Other themes of secondary games (not shown) are contemplated including games simulating other virtual themes such as western themes, fishing themes, sports themes, board games, or other virtual worlds where virtual characters can compete individually or team up to pursue a common goal (e.g., beating another team, defeating a villain, defeating a robot, arriving at a certain destination, catching fish, making a basket or goal, scoring a touchdown). In some aspects of a secondary game, one of the virtual characters may accrue some or all of the awards associated with the secondary game. In some aspects, active virtual characters may share the awards from the secondary game.

It is contemplated that one desirable aspect of the of the wagering game as described herein is that the selection of the number and type of base games is part of the wagering game and operates to determine certain features of the wagering game. For example, the placement of a certain base game in the game build interface and subsequently in the gameplay interface can be used to adjust the volatility of the wagering game. So, if one base game is place on the bottom base game window there may be a lower volatility but if the same base game is instead placed in the top base game window the wagering game may have a higher volatility. The wagering game can therefore be affected the number a base games and the placement of the base games when building the primary wagering game.

Figure 7:
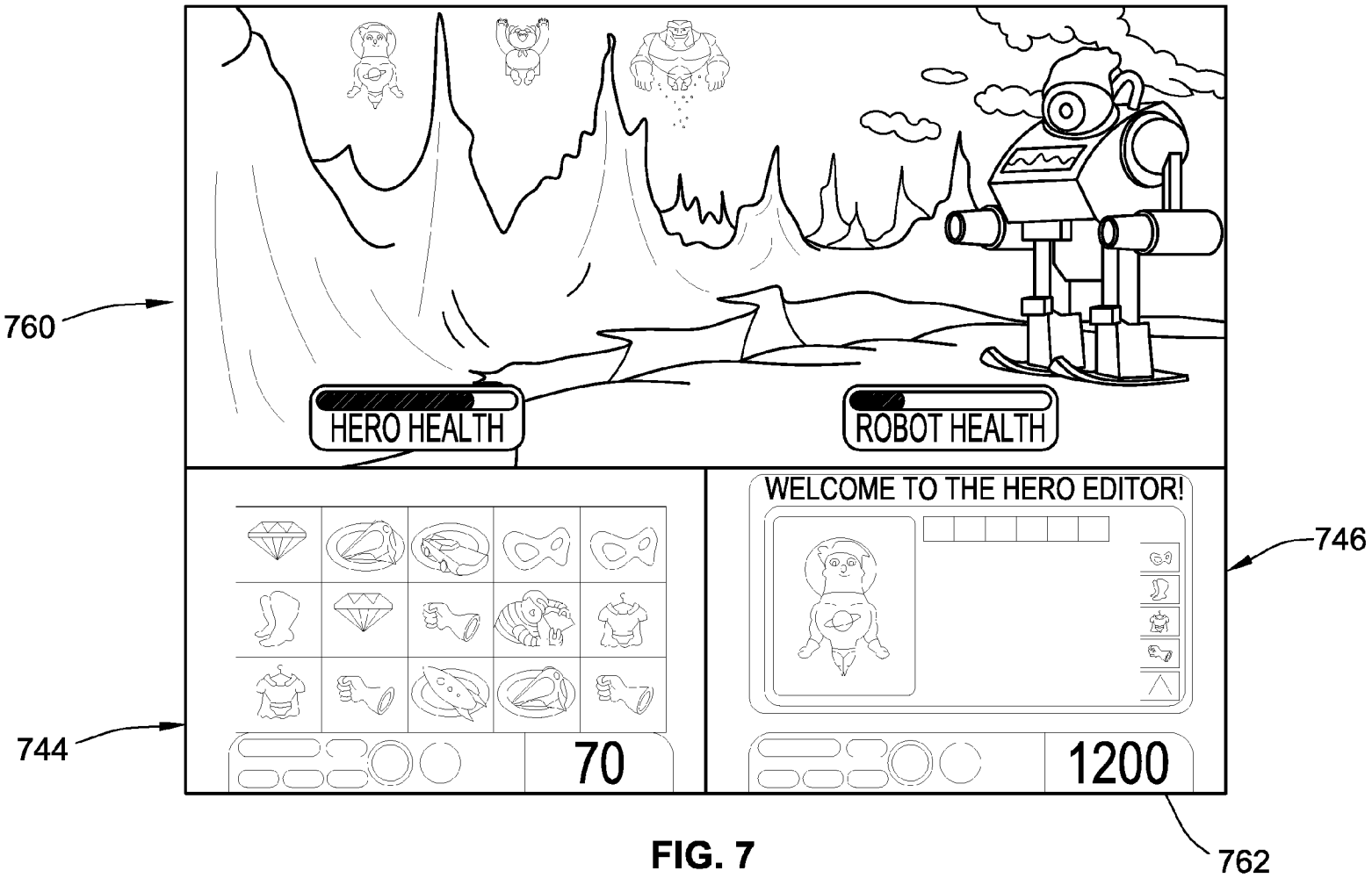

Referring now to FIG. 7, an exemplary aspect is illustrated of one or more display regions of a display area. The display regions include a simulated top box 760 displaying a secondary game common to one or more base games, an exemplary base game window 744, and a virtual character editor window 746. A virtual character editor may be accessed by a player during wagering game play our through other non-wagering game media associated with a gaming system. In some aspects, a player may opt to make changes to one or more of the virtual characters associated with selected base games. Such changes can be made using the virtual character editor window 746 or a similar editor interface. A player may enter the editor window by selecting a button from a common panel (e.g., 626) or by selecting a desired character window, such as the character windows (e.g., 646*a*, 646*b*, 646*c*) described for FIG. 6. The editor window 746, can include a window point display window 762 for displaying the total non-monetary award points a player has accrued and that are available to purchase new characteristics for customizing the virtual character. Furthermore, the editor window 746 may also include a player's inventory of collected characteristics purchased previously with non-monetary award points or characteristics received as awards during game play of the secondary game, the base games, a bonus game, or combinations thereof. A player can then customize the virtual character with various combinations of outfits, weapons, health, defenses, or special powers for subsequent use during play of the secondary game that are displayed as icons in a player's inventory or characteristics available for purchase. The selected characteristics can then alter and will generally enhance a virtual character's abilities during play of the secondary game.

In some aspects, it is contemplated that a virtual character is persistent and may be stored for subsequent primary wagering game sessions or for subsequent non-gaming sessions. The persistent aspects of a virtual character can include the last used virtual character characteristics, inventories, and accumulated non-monetary points being saved on the gaming system such that a player can keep and use the accumulated characteristics and non-monetary awards during subsequent game play.

In addition to collecting characteristics as part of the play of the primary wagering game or related bonus or secondary games, it is also contemplated in some aspects that a player may accrue non-monetary awards or characteristics during play of games outside of the gaming system. For example, the gaming system may be associated with a social media game that also allows play with the virtual character in a non-gaming context, for the same or a similar game to the secondary game. Based on play by the player in the social media game, a virtual character may accrue certain characteristics or non-monetary awards that can be selected or redeemed for use during the secondary game. Thus, it is contemplated that virtual characters are accessible to a player as part of the secondary game and as part of the social media game during non-wagering game play.

The social media game may be a community game accessible to a plurality of players, where each of the plurality of players are associated with at least one virtual character active during the community game. In some aspects, the secondary game may be the same game played during the non-wagering game play. For example, a player engaged in play of the secondary game may do so as part of the player's play through the gameplay interface, such as interface 602. Furthermore, play of the secondary game may also include, in addition to activated virtual character(s) in wagering game, virtual characters associated with the social media environment (e.g., non-gaming environment) that are attempting to achieve a similar goal as the virtual character(s) from the gaming environment. Thus, in some aspects, the players interacting through their virtual character(s) in the secondary game can include wagering game players and non-wagering game players.

In some aspects, it may be desirable to provide different award or experience levels to players of the secondary game depending on whether the respective virtual character enters the secondary game from a wagering or non-wagering environment. For example, if a player enters from a non-wagering environment, the respective virtual character may be a smaller size than the virtual character entering the secondary game from a wagering environment. A player entering from the wagering environment may also receive additional benefit including higher award opportunities, better characteristic options, or increased virtual character health over the player entering from the non-wagering environment.

In some aspects, a player may be able to select from a plurality of secondary game options before initiating the primary wagering game. It is further contemplated that a player's non-gaming play in the virtual world can be applied to play of the secondary game or bonus game based on the same virtual world such that the non-gaming play affects the volatility of results during wagering game play. For example, if the virtual world is based on a simulated city, during non-gaming play, a player could build a town. Based on how the player builds the town can be used to determine the volatility of the secondary game or outcomes of the bonus game spins.

So, if during non-gaming play in the virtual world the player builds fewer police stations or fire stations or the simulated world is experiencing erratic weather events ((e.g., increasing safety concerns in the virtual environment), a player's subsequent play of the bonus game may be highly volatile (e.g., higher awards, but fewer winning outcomes) though the overall odds of winning and payback of the wagering game remains the same. In contrast, if a player conservatively builds their simulated virtual world during non-gaming play the player's subsequent play of the bonus game may be less volatile (e.g., lower award but a higher frequency of winning outcomes). Thus, a player can manage their desired volatility of wagering game play through their behavior during play of a non-wagering game associated with the wagering game.

It is contemplated that the characteristics selected for a virtual character can also be used to determine the volatilities of the base games in the primary wagering game. Thus, in some aspects, choices or selections made by a player of characteristics to associate or activate for their virtual character can be used to define the volatility of the primary wagering game, including the base wagering games. The characteristics affecting the volatility of the primary wagering game can include activated, and in some aspects non-activated, characteristics in a player's inventory, characteristics that are purchased with virtual currency, or characteristics that are otherwise collected during secondary game play. A further desirable aspect is that the volatility effects on the primary wagering game due to the characteristics of virtual character(s) occurs for a primary wagering game including a plurality of base games. So, in some aspects, the volatilities across the various plurality of base games is affected by selected virtual character characteristics, and thus, volatilities for individual base games may change as the virtual character characteristics or options are altered. However, it is contemplated that while volatility may change for the primary wagering game, the overall expected value will remain the neutral.

It is further contemplated that volatilities of the primary wagering game, while maintaining a neutral expected value, can also be altered based on a player choice or selection of the number of arrays to include as base games in the primary wagering game, the types or array or games that are selected, and the placement or layout of the arrays or games within the game play interface (e.g., 122, 602).

Figure 8:
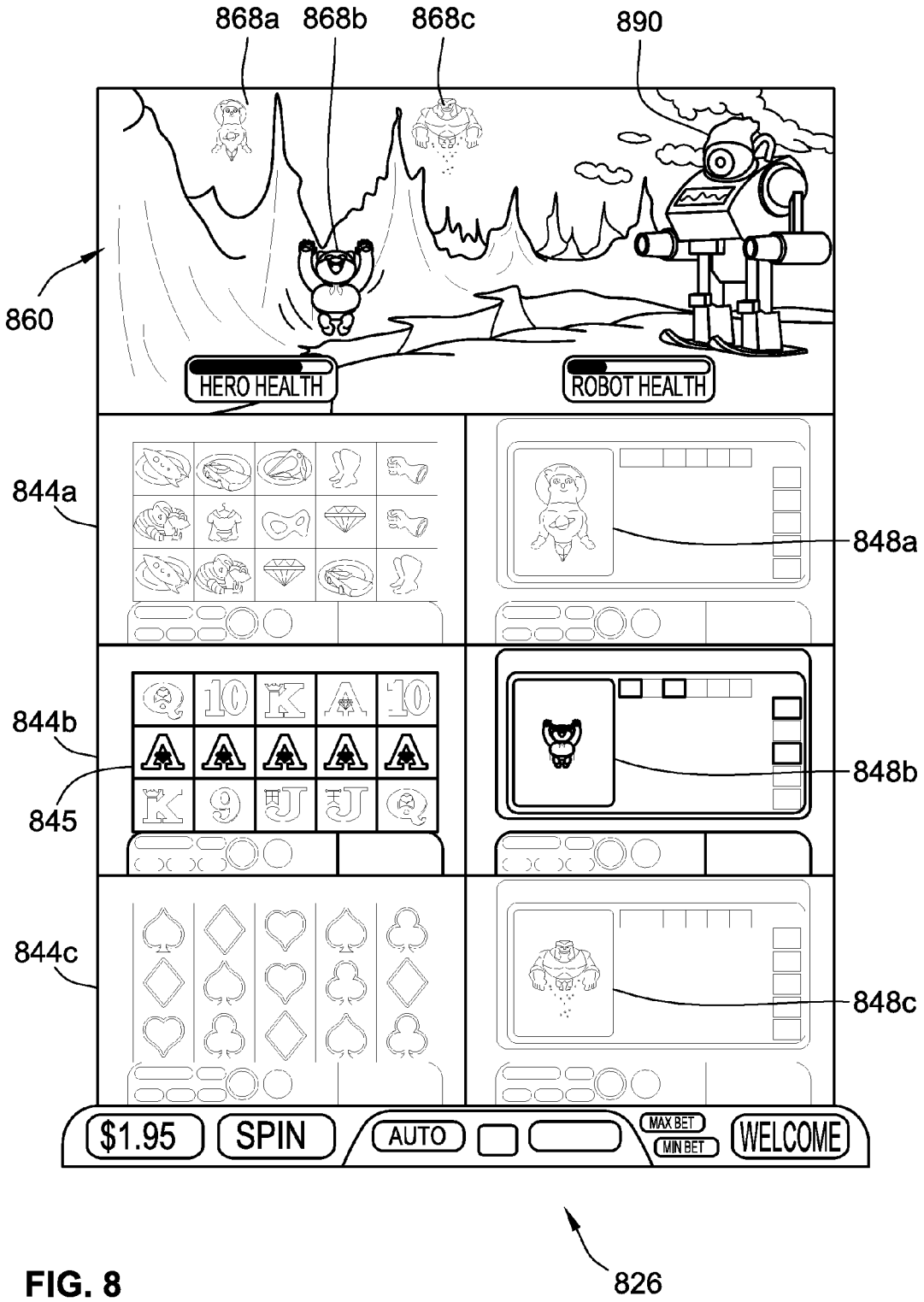
FIGS. 8-10 are conceptual diagrams that illustrate exemplary bonus game play on a wagering game interface including a plurality of base games and a common virtual top box, according to some embodiments.
Figure 9:
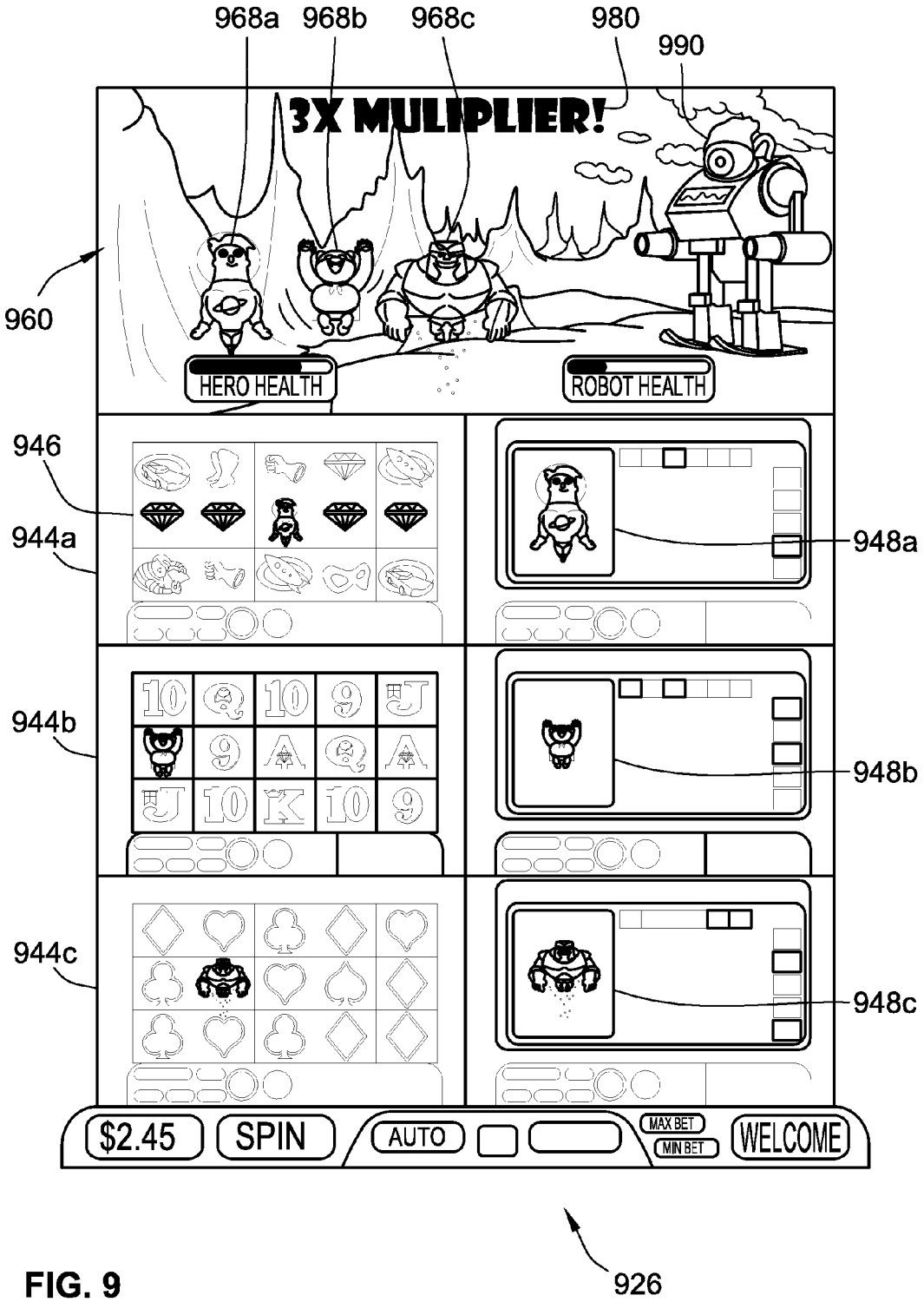

Referring now to FIGS. 8 and 9, exemplary aspects of a primary wagering game with a plurality of base games is illustrated including a bonus trigger activating virtual character(s) within the secondary game common to the plurality of base games. In FIG. 8, an exemplary primary wagering game is illustrated with three base game windows 844*a*, 844*b*, 844*c* displaying three exemplary base slots games, each associated with a virtual character displayed in an adjacent virtual character window 848*a*, 848*b*, 848*c*. Following the initiation of the primary wagering game and receiving an input initiating a spin of the reels in each of the base slots games, a winning outcome 845 (e.g., A-A-A-A-A) is achieved in the base slots game displayed in base game window 844*b*. A player may be awarded a predetermined number of points in response to achieving the winning outcome. Furthermore, the winning outcome can also be a trigger for initiating a bonus game. In the example of FIG. 8, the bonus game is initiated as a result of the trigger. The virtual character window 848*b* for the virtual character associated with the winning base slots game can be highlighted or otherwise identified. Furthermore, play of the secondary game in the simulated top box is activated, where the virtual character 868*b* associated with the winning base slots game becomes activated and the remaining virtual characters 868*a*, 868*c* associated with non-winning or non-triggering base game events remain inactive. While a winning outcome based bonus trigger is illustrated in FIG. 8, other bonus triggers are contemplated including mystery triggers.

In FIG. 9, an exemplary primary wagering game is illustrated with three base game windows 944*a*, 944*b*, 944*c* displaying three exemplary base slots games, each associated with a virtual character displayed in an adjacent virtual character window 948*a*, 948*b*, 948*c*. Following the initiation of the primary wagering game and receiving an input initiating a spin of the reels in each of the base slots games, a symbol bonus trigger 945*a*, 945*b*, 945*c* is achieved in each of the base games displayed in base game windows 944*a*, 944*b*, 944*c* causing a bonus game to be initiated. The virtual character windows 948*a*, 948*b*, 948*c* associated with the base slots games are also highlighted or otherwise identified as a result of the bonus trigger. Active characteristics of the virtual characters may also be highlight within the respective characteristic windows. Furthermore, play of the secondary game in the simulated top box is activated, where the virtual characters 968*a*, 968*b*, 968*c* associated with the base slots game becomes activated. In addition, to the bonus trigger, a winning outcome can also be achieved in the slots games. For example, a winning outcome 946 (e.g., Diamond-Diamond; Diamond-Diamond-Bonus Trigger-Diamond-Diamond) is achieved in the base slots game displayed in base game window 944*a*. A player may be awarded a predetermined number of points in response to achieving the winning outcome. Furthermore, a symbol bonus trigger can also operate as a wild symbol and be used to determine a winning outcome. In addition, select winning outcomes, such as five of the same symbols along a payline can also lead to enhanced virtual character characteristic or enhanced bonus play during implementation of the bonus game. For example, the virtual character 968*a* may have additional powers activated or may achieve additional points for engaging in similar activities as virtual character 968*b* or 968*c*.

It is also contemplated that a multiplier can be awarded based on the outcomes of the base games. For example, in FIG. 9, a multiplier 980 is awarded based on all three base slots game achieving a bonus trigger. In some aspects, the multiplier may correlate with the number of bonus triggers. So, a 3× multiplier may be achieved if three bonus triggers are achieved in the primary wagering game or a 2× multiplier if two bonus triggers are achieved.

Figure 10:
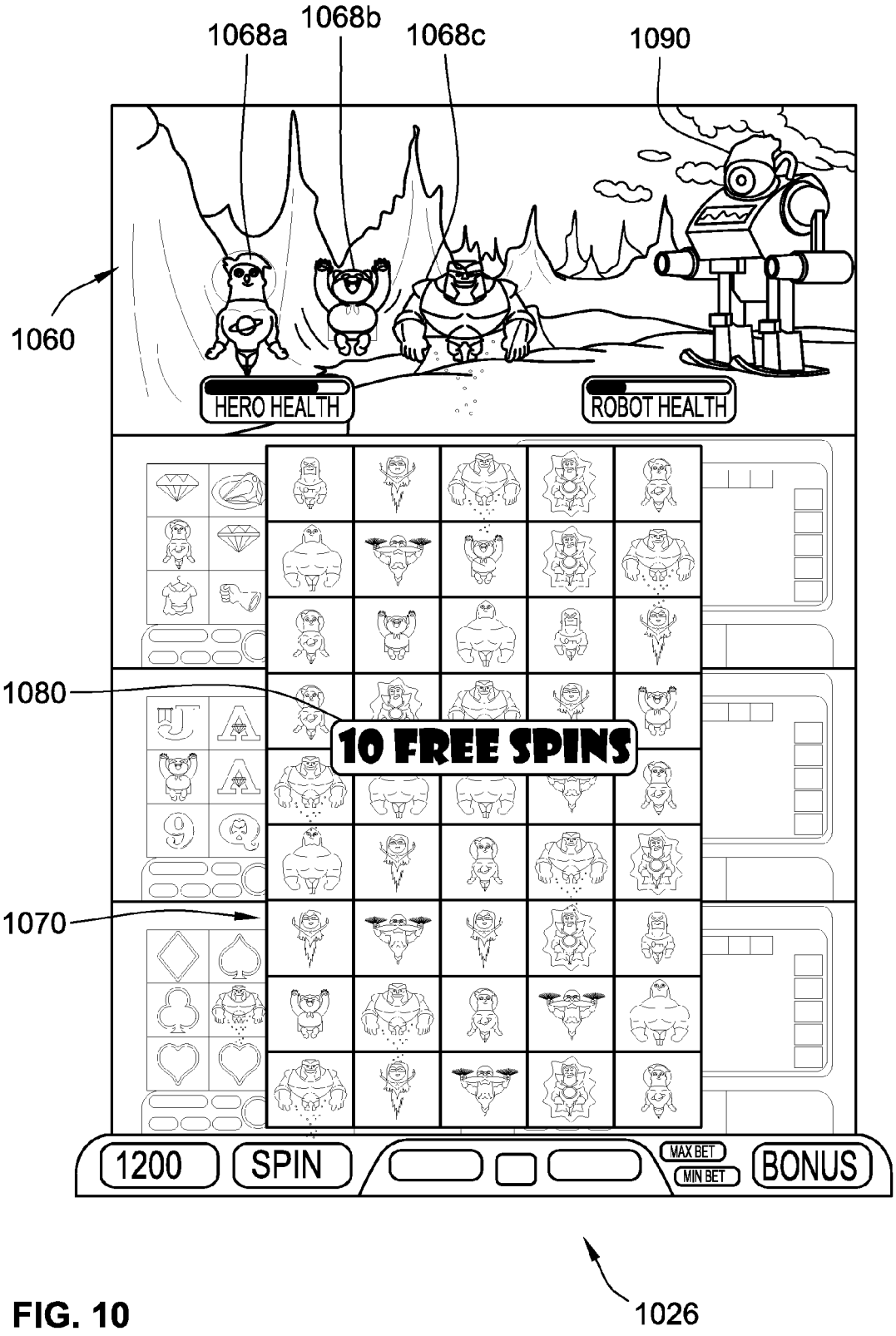

Referring now to FIG. 10, an exemplary aspect of a bonus game initiated by a bonus trigger (e.g., symbol triggers, mystery trigger) in a primary wagering game is illustrated. As discussed in FIGS. 8 and 9, a bonus trigger (e.g., a winning outcome, the appearance of base game virtual character along a payline) in one or in a plurality of the base game arrays can trigger a bonus game. For example, in response to a bonus trigger, virtual characters 1068*a*, 1068*b*, 1068*c* (e.g., superheroes) may be activated in a secondary game displayed in the simulated top box 1060 common to the plurality of base games.

In some aspects, the bonus trigger may or may not include achieving a certain outcome in one or more of the base games (e.g., a predetermined number of virtual characters being activated, certain winning outcomes, the appearance of a wild symbol). The bonus game can include transforming at least a portion of a wagering game interface into bonus slots reels. A player may further be awarded a predetermined number of free spins of the bonus slots reels. For example, a player may receive an award 1080 including 10 free spins.

In some aspects, the bonus slot reels 1070 are formed as a combination or morphing of each of the base games from the primary wagering game where the bonus slot reels overlay an underlying primary game or the bonus slot reels can temporarily replace the display regions occupied by the base games. For example, in FIGS. 8 and 9, the primary wagering game is built with three base slots games each comprising a 5×3 array. The three base games are then combined or morphed in the bonus slots game such that a 5×9 array of symbols is created for the bonus slots game 1070. Symbols arrays of different dimensions are also contemplated. In some aspects it is desirable for the bonus slots array to match the width of the base game arrays and the height to be determined by the number of base games played such that the more base games that are played, the bigger the array, and thus, the greater opportunity for a player to achieve bonus award(s) during play of the bonus slots game. Thus, if a player selects five or eight base games, where each base game comprises a 5×3 slots array, the bonus slots array will be a 5×15 or 5×24 slots array.

Symbols having a similar or different theme from the primary wagering game may be used for the bonus slots game. For example, the bonus slots array 1070 includes superhero symbols for the virtual characters associated with each of the base games in the primary wagering game.

A wagering game according to the aspects described herein offers a player the opportunity to increase the player's odds of triggering a bonus game and also the number of possible active virtual characters for the secondary game in the simulated top box which provides increased features during the bonus game. The player can thus receive increased opportunities by increasing the number of base games selected for the primary wagering game. The increased number of base game also increases a player's wager amount for the primary wagering game.

The virtual characters, such as the virtual characters 868*b* or 968*a*, 968*b*, 968*c* in FIGS. 8 and 9, once activated as part of the bonus game are provided the opportunity to engage or interact with a villain character, such as robot 1090 in the secondary game display in simulated top box 1060. The opportunities to engage or interact with the villain character can be determined by free spins of the bonus slots game.

Figure 11:
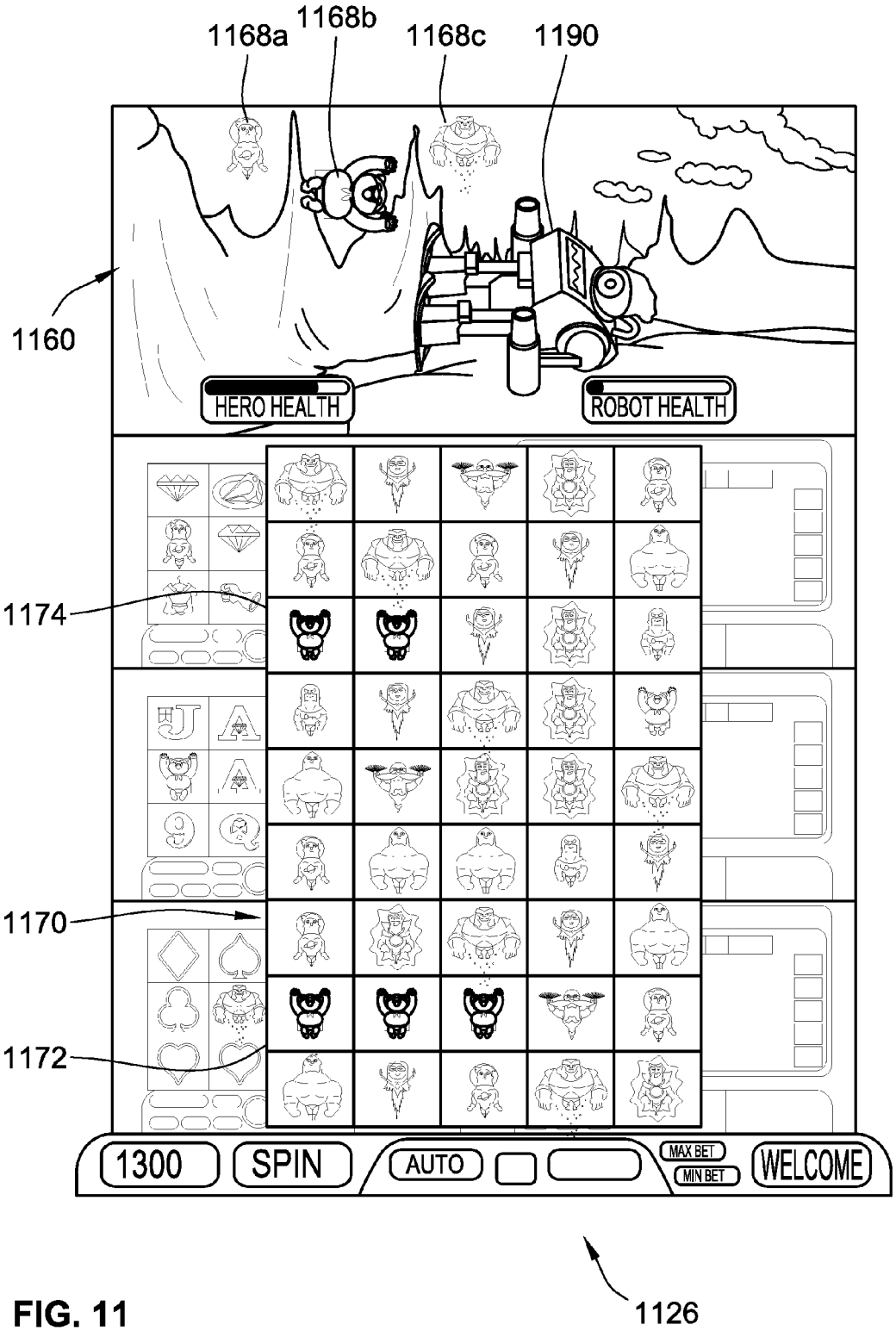
FIGS. 11 and 12 are conceptual diagrams that illustrate exemplary secondary game play in a common virtual top box on a wagering game interface, according to some embodiments.
Figure 12:
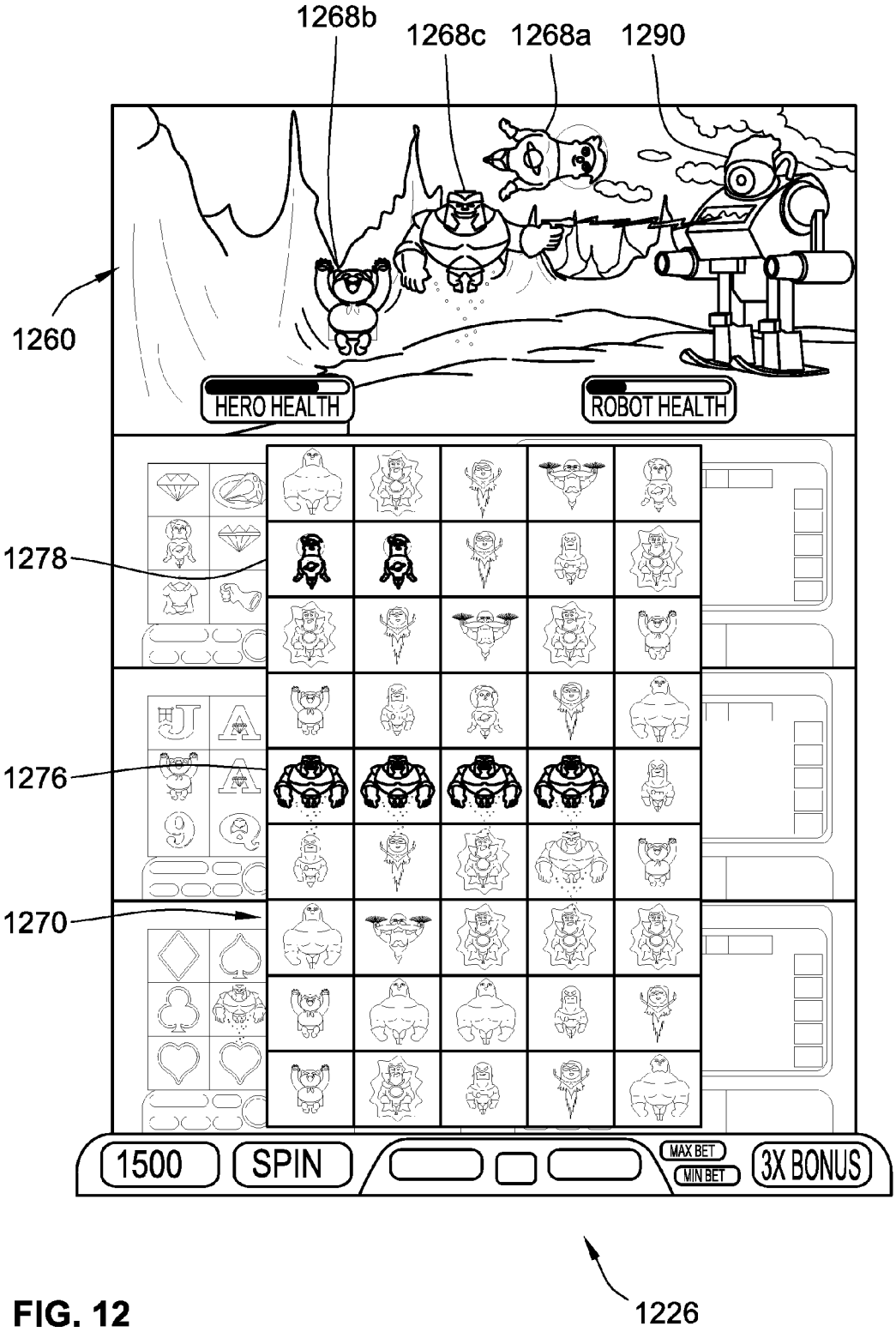

Referring now to FIGS. 11 and 12, exemplary aspects of secondary game play are illustrated involving a bonus slots game. In FIG. 11, one of the virtual characters 1168*b* is active and interacts with the virtual world in response to free spins of the bonus slots array 1170. A player then selects a spin button on a button panel 1126 or the free spins may occur automatically. In response to an exemplary free spin, two separate winning outcomes are achieved along the horizontal lines extending from elements 1172 and 1174. In this example, outcomes based on the appearance of the highlighted active superhero symbol along a payline causes the virtual character 1168*b* to engage the villain character 1190 two times or with one enhanced interaction such that the villain character 1190 is toppled over furthering the virtual characters advancement to a goal. The toppling of the villain character causes a health meter for the villain character (e.g., robot health) to decrease. Furthermore, the virtual character also achieves virtual currency or points for every interaction with the villain character that causes the villain characters health to decrease. In some aspects, other combinations of symbols along a payline in the bonus slots game lead to other outcomes. It is also contemplated that if no winning outcome is achieved during a free spin of the bonus slots game, the villain character 1190 could interact with the virtual character 1168*b* causing the virtual character's health meter (e.g., hero health) to decrease. A bonus game will end when a player has either exhausted the award of free spins or the virtual character's health reaches zero.

In FIG. 12, a plurality of virtual characters (e.g., 1268*a*, 1268*b*, 1268*c*) are active and are configured to interact with the virtual world in response to free spins of the bonus slots array 1270. A player then selects a spin button on a button panel 1226 or the free spins may occur automatically. In response to an exemplary free spin, two separate winning outcomes are achieved along the horizontal lines extending from elements 1276 and 1278. In this example, the outcome based on the appearance of the highlighted active virtual character symbols along horizontal payline extending from element 1276 causes the virtual character 1268*c* to engage the villain character 1290 with a light ray resulting in the villain character's 1290 health to be reduced. Similarly, the outcome based on the appearance of the highlighted active virtual character symbols along horizontal payline extending from element 1278 causes the virtual character 1268*a* to engage the villain character 1290 by flying through the air and using the virtual characters strength to inflict a horizontal force onto the villain character 1290 and also cause the villain character's health to further decrease. Virtual character 1268*b* may remain in place as no winning outcomes were achieved during the spin to cause the virtual character 1268*b* to engage the villain character. Virtual character 1268*b* can also have its health reduced if no winning outcome is achieved for the virtual character 1268*b* because the villain character 1290 may engage the virtual character with some of the villain character's special powers. Furthermore, virtual character 1268*a*, 1268*c* can also achieve virtual currency or points for every interaction with the villain character 1290 that causes the villain characters health to decrease. Similar, virtual character 1268*b* may lose point or virtual currency or may have a reduction on its health meter. In some aspects, other combinations of symbols along a payline in the bonus slots game lead to other outcomes. It is also contemplated that if no winning outcome is achieved during a free spin of the bonus slots game, the villain character 1290 can interact with one or more of the virtual characters (e.g., 1268*a*, 1268*b*, 1268*c*) causing the virtual characters' health meter (e.g., heroes' health) to decrease. In some aspects, each virtual character will have a separate health meter.

It is contemplated that in the bonus slots game, winning outcome can be achieved using a variety of special symbols. For example, some of the symbols of active virtual characters can be expanding wilds that may expend and take up an entire reel or an entire payline. Other symbols of the active virtual characters may be multipliers to an award of virtual points or a separate bonus award payout or other symbols can be scatter pay symbols.

A bonus game may end once a health meter of a virtual character or a villain character reaches zero. A bonus game may also end when all the free spins awarded for the bonus play are exhausted. In some aspects, if additional free spins remain after a health meter reaches zero, another villain character or virtual character may appear in the simulated top box. At the end of the bonus game, a player is awarded the points earned during the bonus game subject to any multiplier or other award enhancements.

Other types of virtual world are contemplated for the second game. For example, the virtual world can be a simulated city where in response to certain outcomes of the bonus slots game or based on certain characteristics of a player (e.g., farming equipment, construction equipment) the virtual character(s) can plant or build things. It is contemplated therefore that when a virtual character is activated as a result of base game outcomes, the virtual character is given opportunities to change or otherwise affect the virtual world displayed in the simulated top box.

Figure 13:
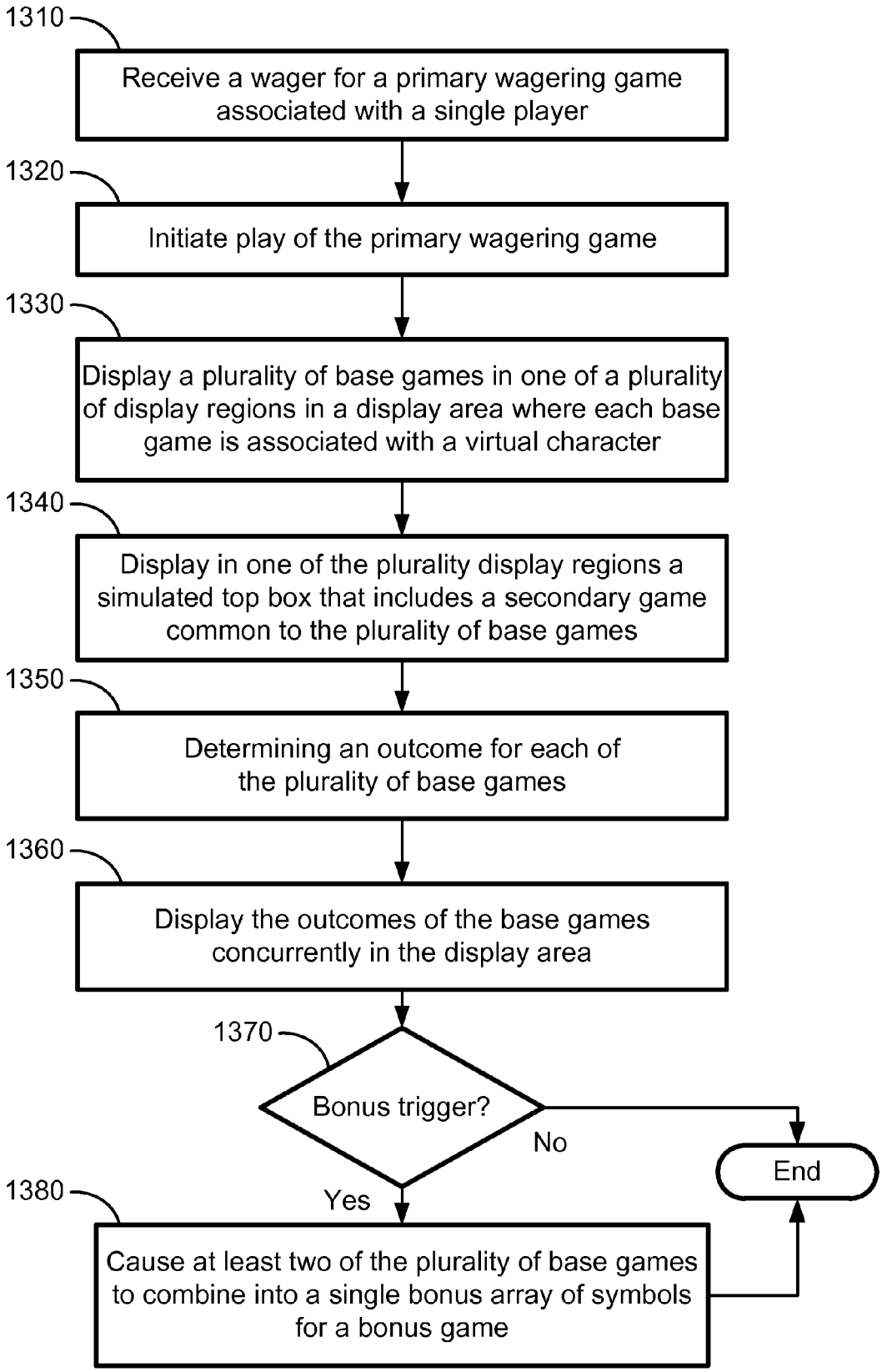
FIG. 13 is a flowchart for an algorithm that corresponds to instructions executed by a controller in accord with at least some aspects of the disclosed concepts.

FIG. 13 is a flowchart for an algorithm that corresponds to instructions executed by a controller in accord with at least some aspects of the disclosed concepts. The method begins at step 1310 with receiving, via one or more input devices, an input indicative of a wager for a primary wagering game associated with a single player. At step 1320, play of the primary wagering game is initiated initiating via at least one of the one or more processors. At step 1330, the primary wagering game is displayed in a display area subdivided into a plurality of display regions. The primary game includes a plurality of base games each having an array of symbols. Each of the base games are displayed in a respective one of the plurality of display regions and have a virtual character associated therewith. At step 1340, a simulated top box is displayed in one of the plurality of display regions. The simulated top box includes a secondary game common to at least the plurality of base games. Next, at step 1350, in response to play of the primary wagering game being initiated, an outcome for each of the plurality of base games is determined. Then, at step 1360, the outcomes are concurrently displayed in the display area. If a bonus trigger (e.g., symbol trigger, mystery trigger, outcome trigger) occurs at step 1370, the process proceeds to step 1380 where at least two of the plurality of base games combine or morph into a single bonus array of symbols for a bonus game. The single bonus array of symbols is displayed in one or more of the plurality of display regions. If a bonus trigger does not occur, the method then ends. According to some aspects of the method in FIG. 13, the bonus trigger in step 1370 includes that the outcomes of at least two of the plurality of base games have a bonus trigger symbol.

It is contemplated that the bonus game is a bonus slots game and the secondary game is a virtual world game. The above method may also include that in response to the outcome of at least two of the plurality of base games including a bonus trigger, at least one of the virtual characters from the at least two of the plurality of base games activates in the virtual world game displayed in the simulated top box. The virtual character(s) may further be configured to implement a special feature in the bonus slots game. In certain aspects, the special feature includes at least one of an expanding symbol, a multiplier, and a scatter symbol.

In some aspects, in response to the outcome of all of the plurality of base games including a bonus trigger, a player is awarded a plurality of free spins where the play of the secondary game is determined by the outcomes of the free spins. It is further contemplated that a secondary game may include a social media game, and the respective virtual characters are persistent and further associated with the social media game. The virtual characters may be accessible to a player as part of the secondary game during play of the primary wagering game and as part of the social media game during non-wagering game play. In some aspects, the social media game is a community game accessible to a plurality of players where each of the plurality of players is associated with at least one virtual character. It is also contemplated that the plurality of players includes wagering game players and non-wagering game players.

A virtual villain character may be activated and be displayed in the virtual world game. The virtual villain character can have a first health value. In response to a winning outcome during play of the bonus slots game, the first health value of the virtual villain character may decrease. In response to a non-winning outcome during play of the bonus slots game, a second health value associated with the at least one virtual character associated with the non-winning outcome may also decrease. In some aspects, a special feature may be awarded in response to the first health value decreasing below a first threshold value, or the slots game may end in response to the second health value decreasing below a second threshold value. In some aspects, in response to ending the slot game, each of the plurality of base games are displayed in their respective display regions in the primary display area.

It is contemplated that in some aspects at least two virtual characters are activated in the virtual world game displayed in the simulated top box. Each virtual character is associated with a respective base game. It is further contemplated that a plurality of villain characters may be activated.

Figure 14:
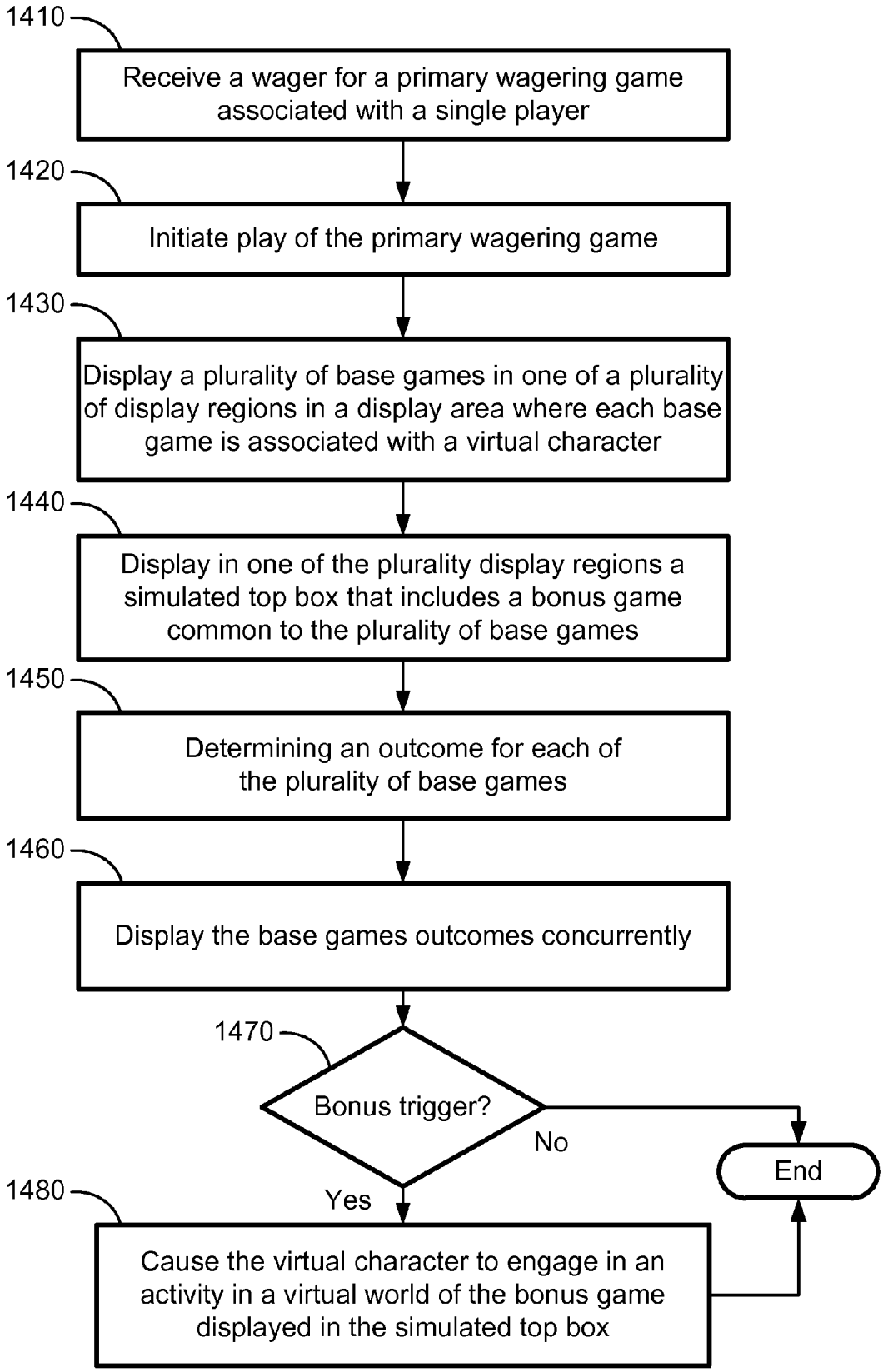
FIG. 14 is another flowchart for an algorithm that corresponds to instructions executed by a controller in accord with at least some aspects of the disclosed concepts.

FIG. 14 is another flowchart for an algorithm that corresponds to instructions executed by a controller in accord with at least some aspects of the disclosed concepts. The method includes receiving at step 1410 an input indicative of a wager for a primary wagering game associated with a single player. At step 1420, play of the primary wagering game is initiated via one or more processors. At step 1430, the primary wagering game is displayed in a display area subdivided into a plurality of display regions. The primary game includes a plurality of base games each having an array of symbols. Each of the base games are displayed in a respective one of the plurality of display regions and have a virtual character associated therewith. Next, at step 1440, a simulated top box is displayed in one of the plurality of display regions. The simulated top box includes a bonus game common to at least the plurality of base games. At step 1450, in response to initiating play of the primary wagering game, an outcome for each of the plurality of base games is determined via at least one of the one or more processors. At step 1460, the outcomes are displayed concurrently in the display area. Next at step 1470 a determination is made whether a bonus trigger is received. If a bonus trigger is not received, the process then ends. If a bonus trigger is received, the process proceeds to step 1480 where the virtual character is caused via at least one of the one or more processors to engage in an activity in a virtual world of the bonus game displayed in the simulated top box.

The bonus trigger at step 1470 can include in some aspects that the outcome of at least one of the plurality of base games includes a virtual character trigger or a mystery trigger. The bonus trigger can also include an award of a plurality of free spins such that the associated virtual character engages in activity in the virtual world based on the subsequent outcomes of the plurality of free spins. If a bonus is achieved in at least two of the plurality of base games, a special award of additional free spins may be achieved in addition to the plurality of free spins. In some aspects, the bonus trigger can include achieving a bonus symbol in at least two of the plurality of base games.

In some aspects, one or more awards may also be received during play of the bonus game as a result of the activity of the virtual character(s) in the virtual world. Furthermore, the number base games played in the primary wagering game can be player-selectable such that a selection of a greater number of base games allows for enhanced awards to be received during play of the bonus game in comparison to the awards received during play of a bonus game with a selection of fewer base games.

The number of base games played in the primary wagering game can determine a theme for the bonus game displayed in the simulated top box. It is further contemplated that the type of base games played in the primary wagering game determines a theme for the bonus game displayed in the simulated top box.

A gaming system can also be configured to display a customization window in one of the plurality of display regions. The customization window can include player-selectable elements for editing a virtual character associated with a base game of the primary wagering game.

A virtual world for the gaming system can include gaming and non-gaming participants. The gaming participants may have the opportunity to win monetary awards and the non-gaming participants may have the opportunity to win non-monetary awards. In one example, awards including non-monetary virtual credits redeemable for new features for a player's virtual character.

In some aspects of the wagering game of FIG. 14, the gaming system receives a player input of the number of base games that will be played in the primary wagering game. The received player input of the number of base games can determine (e.g., increase, decrease) a volatility in outcomes of the primary wagering game with the expected value of the overall primary wagering game remaining constant. It is also contemplated that placement of the base games in the display area may determine the volatility of the primary wagering game. It is further contemplated that virtual character activity in the virtual world of the bonus game can adjust the expected value between different features of the primary wagering game with the overall expected value for the primary wagering game remaining neutral.

In some aspects, the gaming system awards a special award in response to all of the virtual characters from the base games being triggered. The special award is awarded in addition to a base bonus award. It is also contemplated that a virtual character's activity in the virtual world of the bonus game determines outcomes in the plurality of base games.

FIGS. 13 and 14, described by way of example above, represents algorithms that correspond to at least some instructions executed by the system 100 described for FIGS. 1-3 or the systems 410 or 448 in FIG. 4 to perform the above described functions associated with the disclosed concepts.

According to yet other aspects of the present disclosure, a gaming system can include one or more input devices, a display device, one or more processors, one or more memory devices, and a communication network interface connecting the input device(s), display device(s), processor(s), and/or memory device(s). The one of more memory devices store instructions that, when executed by the one or more processors, cause the gaming system to receive, via at least one of the one or more input devices, an input indicative of a wager for a primary wagering game associate with a single player. Play of the primary wagering game is then initiated. The primary wagering game is displayed in a display area of the display device. The display area is subdivided into a plurality of display regions. The primary game can include a plurality of base games each having an array of symbols. Each of the base games are displayed in a respective one of the plurality of display regions and have a virtual character associated therewith. A simulated top box is displayed in one of the plurality of display regions. The simulated top box includes a bonus game common to at least the plurality of base games. In response to initiating play of the primary wagering game, an outcome for each of the plurality of base games is determined and the outcomes are displayed concurrently in the display area. Then, in response to a bonus trigger, such as the outcome of at least one of the plurality of base games including a virtual character trigger or a mystery trigger, the virtual character associated with the at least one of the plurality of base games engages in an activity in a virtual world of the bonus game displayed in the simulated top box.

In some aspects, the above gaming system includes one or more awards being received during play of the bonus game as a result of the activity of the virtual character(s) in the virtual world. Furthermore, the number base games played in the primary wagering game are player-selectable such that a selection of a greater number of base games allows for enhanced awards to be received during play of the bonus game in comparison to the awards received during play of a bonus game with a selection of fewer base games.

The number of base games played in the primary wagering game for the above gaming system can determine a theme for the bonus game displayed in the simulated top box. It is also contemplated that the type of base games played in the primary wagering game can determine a theme for the bonus game displayed in the simulated top box.

In some aspects, the one or more memory devices of the above gaming system include instructions that, when executed by the one or more processors, cause the gaming system to display a customization window in one of the plurality of display regions. The customization window can include player-selectable elements for editing a virtual character associated with a base game of the primary wagering game.

In some aspects, it is contemplated that the virtual character trigger in the above gaming system can include an award of a plurality of free spins such that the associated virtual character engages in activity in the virtual world based on the subsequent outcomes of the plurality of free spins. It is further contemplated that if a bonus is achieved in at least two of the plurality of base games, a special award of additional free spins can be achieved in addition to the plurality of free spins. A virtual character trigger for the above gaming system may also include achieving a bonus symbol in at least two of the plurality of base games.

It is contemplated that the virtual world of the bonus game may be a virtual sports world. It is also contemplated that the virtual world can include gaming and non-gaming participants, where the gaming participants have the opportunity to win monetary awards and the non-gaming participants have the opportunity to win non-monetary awards. Awards for the gaming system can also include non-monetary virtual credits redeemable for new features for a player's virtual character or for new features in the virtual world of the bonus game. In certain aspects, the awards are achieved in one or more of the base games.

According to some aspects, the one or more memory devices of the above gaming system include instructions that, when executed by the one or more processors, cause the gaming system to receive a player input of the number of base games that will be played in the primary wagering game. It is further contemplated that the received player input of the number of base games determines a volatility in outcomes of the primary wagering game with the expected value of the overall primary wagering game remaining constant. In some aspects, the placement of the base games in the display area can determine the volatility of the primary wagering game. In yet other aspects, the one or more memory devices of the above gaming system include instructions that, when executed by the one or more processors, cause the gaming system to receive a player input for different volatilities to be assigned to each of the plurality of base games.

It is contemplated that all the base games may be implemented simultaneously or otherwise in response to a single spin-reel input. Each base game may further have a unique virtual character associated therewith that may be triggered in the virtual world of the bonus game.

According to some aspects, the one or more memory devices of the above gaming system include instructions that, when executed by the one or more processors, cause the gaming system to award a special award in response to all of the virtual characters from the base games being triggered, the special award being awarded in addition to a base bonus award. The special award may be a multiplier.

According to some aspects of the gaming system, a virtual character's activity in the virtual world of a bonus game determines outcomes in the plurality of base games. It is further contemplated that a virtual character's activity in the virtual world of the bonus may game trigger special events in at least one of the plurality of base games. In certain aspects, virtual character activity in the virtual world of the bonus game can adjust the expected value between different features of the primary wagering game with the overall expected value for the primary wagering game remaining neutral.

In some aspects of a gaming system, the plurality of base games includes one or more poker games. It is further contemplated that the plurality of base games may include one or more slots games.

The bonus game for the gaming system can be a social media game where at least some of the virtual characters are persistent and further associated with the social media game. The social media game can be accessible outside of the gaming system environment such that a virtual character can engage in activities in the virtual world of the social media game both inside and outside the gaming system environment. In some aspects, a volatility of a primary wagering game is adjusted based on outcomes achieved during activity outside the gaming system environment.

Play of a bonus game may include at least some virtual characters associated with players of wagering games and other virtual characters not associated with wagering games. The virtual character associated with players of wagering game may be taller or bigger than the other virtual characters not associated with wagering games. For example, the virtual characters associated with players of a wagering game may be 1.5× the height or taller than the virtual characters not associated with the wagering games. It is contemplated that awards may include non-monetary virtual credits redeemable for new features for a player's virtual character, and that virtual characters associated with players of wagering games are allowed to redeem new features unavailable to the other virtual characters not associated with wagering games. In some aspects, awards include non-monetary virtual credits redeemable for new features in the social media game, and the virtual characters associated with players of wagering games are allowed to redeem new features unavailable to the other virtual characters not associated with wagering games.

According to some aspects of the gaming system, the virtual world of the bonus game is a community game including a plurality of virtual characters associated with a plurality of different primary wagering games. The display of the simulated top box can include at least one of the plurality of virtual characters associated with at least one of the plurality of different primary wagering games such that activities in the virtual world displayed in the simulated top box are displayed prior to an outcome including a virtual character trigger in one of the primary wagering games. In certain aspects, a virtual character can only engage in activity in the virtual world of the bonus game if the received input is indicative of a maximum bet.

According to some aspects a gaming system includes one or more input devices, a display device, one or more processors, and one or more memory devices storing instructions that, when executed by the one or more processors, cause the gaming system to perform acts including receiving via at least one of the one or more input devices an input indicative of a wager. A primary wagering game is displayed in a display area of the display device. The display area is subdivided into a plurality of display regions. The primary game includes a plurality of base games each having an array of symbols. Each of the plurality of base games is displayed in one of the plurality of display regions. The primary game is associated with a single player. A simulated top box is displayed in one of the plurality of display regions. The simulated top box includes a bonus game common to the plurality of base games associated with the single player. Play of the primary wagering game is initiated and in response thereto. An outcome for each of the plurality of base games is determined and the outcomes are concurrently displayed in the display area. In response to the outcomes of at least two of the plurality of base games including a bonus trigger (e.g., mystery trigger, symbol trigger, points-based trigger), at least two of the plurality of base games are caused to combine into a single bonus array of symbols for a bonus game. In addition, in some aspects of the gaming system, a plurality of free spins is awarded for a bonus slots game in response to the outcome of at least two of the plurality of base games including the bonus trigger. Play of the bonus game is determined by the number of free spins. The bonus game is displayed in the top box and includes one or more roulette boards such that bets on the one or more roulette boards are determined by outcomes of the free spins of the bonus slots game.

It is contemplated that the display of the roulette game in the simulated top box can include a roulette board and a betting board. The outcomes of the bonus slots games are used to determine wagers placed on the betting board. Then, for example, after a predetermined period of time (e.g., every 30 seconds or every minute) or after a predetermined number of spins (e.g., anywhere from 1 to 5 spins) the roulette wheel may be spun following the placement of the determined wagers.

It is also contemplated that in response to an outcome in the bonus slots game certain awards are awarded in response to achieving a winning outcome in the bonus slots game. The award may or may not include betting opportunities on the roulette betting board. It is also contemplated that outcomes in the bonus slots game may include another trigger for a secondary bonus (e.g., bonus within the bonus slots game) that causes bets or cause larger bets to be placed on the roulette betting board. Larger bets may also be triggered by, for example, a player max betting during the primary wagering game.

Bets can be placed on the betting board automatically in response to outcomes of the bonus slots game. A player can be given more betting options on the betting board if the player selected more base games when building the primary wagering game that is played before receiving and entering the bonus slots game. Bets can be placed on the betting board according to a split of the betting board into quadrants or grids. Each quadrant, grid, or other grouping of the betting board include unique numbers (e.g., 1-12; 13-24; 25-36; or 0 and 00) numbers associated with numbers on the roulette wheel (e.g., 0, 00, and 1-36). Play of the roulette game displayed in the simulated top box may initially be limited to bets in only on group or quadrant of numbers on the betting board. However, a player, for example, increases the number of base game splayed in the primary wagering game, additional groups or quadrants of numbers may be open on the betting board (e.g., bets are placed on two groups or quadrants of numbers).

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system, comprising:

a gaming machine primarily dedicated to playing at least one casino wagering game, the gaming machine including an electronic display device and one or more electronic input devices; and one or more controllers configured to:

detect, via at least one of the one or more electronic input devices, a physical item associated with a monetary value that establishes a credit balance, initiate a primary casino wagering game associated with a single player in response to an input indicative of a wager covered by the credit balance, display on the electronic display device the primary casino wagering game in a display area subdivided into a plurality of display regions, the primary casino wagering game including a plurality of base games each having an array of symbols, each of the base games being displayed in a respective one of the plurality of display regions and having a virtual character associated therewith, display on the electronic display device a simulated top box in one of the plurality of display regions, the simulated top box including a secondary game common to at least the plurality of base games, in response to play of the primary casino wagering game being initiated, determine an outcome for each of the plurality of base games, direct the electronic display device of the gaming machine to display the outcomes concurrently in the display area, in response to a bonus trigger, cause at least two of the plurality of base games to combine into a single bonus array of symbols for a bonus game, the single bonus array of symbols being displayed in one or more of the plurality of display regions, award an award in response to the displayed bonus array of symbols meeting a predetermined award criterion, the award increasing the credit balance, and receive, via at least one of the one or more electronic input devices, a cashout input that initiates a payout from the credit balance.

2. The gaming system of claim 1, wherein the bonus trigger comprises that the outcomes of at least two of the plurality of base games include a bonus trigger symbol.

3. The gaming system of claim 1, wherein the bonus game is a bonus slots game and the secondary game is a virtual world game, and the one or more controllers are further configured to:

in response to the outcome of at least two of the plurality of base games including a bonus trigger, cause at least one of the virtual characters from the at least two of the plurality of base games to activate in the virtual world game displayed in the simulated top box, the at least one of the virtual characters configured to implement a special feature in the bonus game.

4. The gaming system of claim 3, wherein the special feature includes at least one of an expanding symbol, a multiplier, and a scatter symbol.

5. The gaming system of claim 3, wherein the one or more controllers are further configured to:

cause a virtual villain character to activate and be displayed in the virtual world game, the virtual villain character having a first health value;

in response to a winning outcome during play of the bonus slots game, decrease the first health value of the virtual villain character; and in response to a non-winning outcome during play of the bonus game, decrease a second health value associated with the at least one virtual character associated with the non-winning outcome.

6. The gaming system of claim 5, wherein the one or more controllers are further configured to award a special feature in response to the first health value decreasing below a first threshold value.

7. The gaming system of claim 5, wherein the one or more controllers are further configured to cause the gaming system to end the bonus game in response to the second health value decreasing below a second threshold value.

8. The gaming system of claim 7, wherein the one or more controllers are further configured to in response to ending the bonus game, display each of the plurality of base games in their respective display regions in the primary display area.

9. The gaming system of claim 5, wherein at least two virtual characters are activated in the virtual world game displayed in the simulated top box, each virtual character being associated with a respective base game.

10. The gaming system of claim 5, wherein a plurality of villain characters are activated.

11. The gaming system of claim 1, wherein in response to the outcome of all of the plurality of base games including a bonus trigger, the player being awarded a plurality of free spins, the play of the secondary game being determined by the outcomes of the free spins.

12. The gaming system of claim 1, wherein the secondary game includes a social media game, and wherein the respective virtual characters are persistent and further associated with the social media game.

13. The gaming system of claim 12, wherein virtual characters are accessible to a player as part of the secondary game during play of the primary casino wagering game and as part of the social media game during non-wagering game play.

14. The gaming system of claim 12, wherein the social media game is a community game accessible to a plurality of players, each of the plurality of players being associated with at least one virtual character.

15. The gaming system of claim 14, wherein the plurality of players include wagering game players and non-wagering game players.

16. A casino gaming machine primarily dedicated to playing at least one casino wagering game, comprising:

an electronic display device;

one or more electronic input devices; and one or more controllers configured to:

detect, via at least one of the one or more electronic input devices, a physical item associated with a monetary value that establishes a credit balance, initiate a primary wagering game associated with a single player in response to an input indicative of a wager covered by the credit balance, display on the electronic display device the primary wagering game in a display area subdivided into a plurality of display regions, the primary wagering game including a plurality of base games each having an array of symbols, each of the base games being displayed in a respective one of the plurality of display regions, each of the base games further having a different virtual character associated therewith, display on the electronic display device a simulated top box in one of the plurality of display regions, the simulated top box including a bonus game common with at least the plurality of base games, in response to initiating play of the primary wagering game, determine an outcome for each of the plurality of base games, direct the electronic display device to display the outcomes concurrently in the display area, award an award in response to the outcomes meeting a predetermined award criterion, the award increasing the credit balance, in response to a bonus trigger, cause at least one of the virtual characters to engage in an activity in a virtual world of the bonus game displayed in the simulated top box, wherein the bonus game is a social media game, and wherein at least some of the virtual characters are persistent and further associated with the social media game, and receive, via at least one of the one or more electronic input devices, a cashout input that initiates a payout from the credit balance.

17. The casino gaming machine of claim 16, wherein the social media game is accessible outside of the casino gaming machine environment such that a virtual character can engage in activities in the virtual world of the social media game both inside and outside the casino gaming machine environment.

18. The casino gaming machine of claim 17, wherein play of the bonus game includes at least some virtual characters associated with players of wagering games and other virtual characters not associated with wagering games.

19. The casino gaming machine of claim 18, wherein awards include non-monetary virtual credits redeemable for new features for a player's virtual character, and wherein the virtual characters associated with players of wagering games are allowed to redeem new features unavailable to the other virtual characters not associated with wagering games.

20. A method of operating a gaming system, the gaming system including one or more controllers and a gaming machine, the gaming machine primarily dedicated to playing at least one casino wagering game, the gaming machine including an electronic display device and one or more electronic input devices, the method comprising:

detecting, via at least one of the one or more electronic input devices, a physical item associated with a monetary value that establishes a credit balance;

initiating the casino wagering game in response to an input indicative of a wager covered by the credit balance;

initiating, by at least one of the one or more controllers, play of a primary casino wagering game;

displaying the primary casino wagering game in a display area of the electronic display device, the display area subdivided into a plurality of display regions, the primary casino wagering game including a plurality of base games each having an array of symbols, each of the base games being displayed in a respective one of the plurality of display regions, each of the base games further having a different virtual character associated therewith;

displaying a simulated top box in one of the plurality of display regions, the simulated top box including a bonus game common to at least the plurality of base games;

in response to initiating play of the primary casino wagering game, determining, by at least one of the one or more controllers, an outcome for each of the plurality of base games and displaying the outcomes concurrently in the display area;

awarding, by the one or more controllers, an award in response to an outcome meeting a predetermined award criterion, the award increasing the credit balance;

in response to a bonus trigger, causing, by at least one of the one or more controllers, at least one of the virtual characters to engage in an activity in a virtual world of the bonus game displayed on the electronic display device in the simulated top box; and receiving, via at least one of the one or more electronic input devices, a cashout input that initiates a payout from the credit balance.

21. The method of claim 20, wherein the bonus trigger comprises that the outcome of at least one of the plurality of base games includes a virtual character trigger.

22. The method of claim 20, wherein one or more awards are received during play of the bonus game as a result of the activity of the virtual character(s) in the virtual world, and wherein the number base games played in the primary casino wagering game are player-selectable such that a selection of a greater number of base games allows for enhanced awards to be received during play of the bonus game in comparison to the awards received during play of a bonus game with a selection of fewer base games.

23. The method of claim 20, wherein the number of base games played in the primary casino wagering game determines a theme for the bonus game displayed in the simulated top box.

24. The method of claim 20, wherein the type of base games played in the primary casino wagering game determines a theme for the bonus game displayed in the simulated top box.

25. The method of claim 20, further comprising causing, by at least one of the one or more controllers, the gaming system to display a customization window in one of the plurality of display regions, the customization window including player-selectable elements for editing a virtual character associated with a base game of the primary casino wagering game.

26. The method of claim 20, wherein the bonus trigger includes an award of a plurality of free spins such that the associated virtual character engages in activity in the virtual world based on the subsequent outcomes of the plurality of free spins.

27. The method of claim 26, wherein if a bonus is achieved in at least two of the plurality of base games, a special award of additional free spins is achieved in addition to the plurality of free spins.

28. The method of claim 20, wherein the bonus trigger includes achieving a bonus symbol in at least two of the plurality of base games.

29. The method of claim 20, wherein the virtual world includes gaming and non-gaming participants, the gaming participants having the opportunity to win monetary awards and the non-gaming participants having the opportunity to win non-monetary awards.

30. The method of claim 20, wherein awards including non-monetary virtual credits redeemable for new features for a player's virtual character.

31. The method of claim 20, further comprising causing the gaming system to receive a player input of the number of base games that will be played in the primary casino wagering game, wherein the received player input of the number of base games determines a volatility in outcomes of the primary casino wagering game, the expected value of the overall primary casino wagering game remaining constant.

32. The method of claim 20, further comprising causing the gaming system to award a special award in response to all of the virtual characters from the base games being triggered, the special award being awarded in addition to a base bonus award.

33. The method of claim 20, wherein a virtual character's activity in the virtual world of the bonus game determines outcomes in the plurality of base games.

34. The method of claim 20, wherein placement of the base games in the display area determines the volatility of the primary casino wagering game.

35. The method of claim 20, wherein virtual character activity in the virtual world of the bonus game adjusts the expected value between different features of the primary casino wagering game with the overall expected value for the primary casino wagering game remaining neutral.

* * * * *